US010472121B2

(12) United States Patent
Viström et al.

(10) Patent No.: US 10,472,121 B2
(45) Date of Patent: Nov. 12, 2019

(54) PACKAGING BOX, BLANK, METHOD AND APPARATUS FOR FORMING THE SAME

(71) Applicant: SCA Forest Products AB, Sundsvall (SE)

(72) Inventors: Magnus Viström, Sundsvall (SE); Rickard Hägglund, Sundsvall (SE)

(73) Assignee: SCA FOREST PRODUCTS AB, Sundsvall (SE)

( * ) Notice: Subject to any disclaimer, the term of this patent is extended or adjusted under 35 U.S.C. 154(b) by 160 days.

(21) Appl. No.: 15/522,924

(22) PCT Filed: Oct. 31, 2014

(86) PCT No.: PCT/EP2014/073469
§ 371 (c)(1),
(2) Date: Apr. 28, 2017

(87) PCT Pub. No.: WO2016/066220
PCT Pub. Date: May 6, 2016

(65) Prior Publication Data

US 2017/0327265 A1 Nov. 16, 2017

(51) Int. Cl.
*B65D 5/20* (2006.01)
*B65B 5/02* (2006.01)
(Continued)

(52) U.S. Cl.
CPC ..... *B65D 5/2019* (2013.01); *B65B 5/024* (2013.01); *B65B 25/146* (2013.01); *B65B 43/08* (2013.01);
(Continued)

(58) Field of Classification Search
CPC ..... B65D 5/28; B65D 5/18; B65D 5/50209; B65D 5/2019
(Continued)

(56) References Cited

U.S. PATENT DOCUMENTS 3,432,085 A * 3/1969 Lock ..... B65D 5/2033 229/109
3,529,762 A * 9/1970 Johnson ..... B65D 5/22 229/148
3,539,089 A * 11/1970 Osberg ..... B65D 5/48018 229/117.06
4,049,188 A * 9/1977 Persson ..... B65D 5/0015 206/519
4,361,267 A * 11/1982 Wozniacki ..... B65D 5/10 229/109
(Continued)

FOREIGN PATENT DOCUMENTS

JP 2010-030626 A 2/2010
JP 2010-126169 A 6/2010
WO WO-93/04944 A1 3/1993

*Primary Examiner* — Brian D Nash
(74) *Attorney, Agent, or Firm* — Drinker Biddle & Reath LLP

(57) ABSTRACT

A packaging box including a base portion defining a first plane is disclosed. The packaging box includes at least one first side wall portion. The at least one first side wall portion is arranged at an angle to the base portion. The first side wall portion is joined to the base portion via a fold line at a first edge of the base portion. The first side wall portion has an extension portion extending from one side of the side wall portion so as to provide at least part of a second side wall portion arranged at an angle to the base portion and at an angle to the first side wall portion. The second side wall portion includes at least part of the extension portion. A connecting portion of the extension portion connecting the first side wall portion to the second side wall portion is smoothly curved.

22 Claims, 21 Drawing Sheets

(51) Int. Cl.

| | |
|---|---|
| ***B65B 25/14*** | (2006.01) |
| ***B65B 43/08*** | (2006.01) |
| ***B65B 43/34*** | (2006.01) |
| ***B65B 43/26*** | (2006.01) |
| ***B65D 5/42*** | (2006.01) |
| ***B65D 5/66*** | (2006.01) |

(52) U.S. Cl.
CPC ..... *B65B 43/26* (2013.01); *B65B 43/345* (2013.01); *B65D 5/4266* (2013.01); *B65D 5/66* (2013.01)

(58) Field of Classification Search
USPC ..... 229/106, 191, 193
See application file for complete search history.

(56) References Cited

U.S. PATENT DOCUMENTS

| | | | | | |
|---|---|---|---|---|---|
| 4,416,377 | A * | 11/1983 | Swanberg | B65D 5/5435 | 206/538 |
| 4,557,415 | A * | 12/1985 | Carr, Jr. | B65D 5/2019 | 229/125.19 |
| 4,676,429 | A * | 6/1987 | Crowe | B65D 5/2033 | 229/109 |
| 7,290,696 | B2 * | 11/2007 | McClure | B65D 5/443 | 229/117.16 |
| 7,367,490 | B2 * | 5/2008 | Forthaus | B65D 5/2066 | 206/215 |
| 8,272,560 | B2 * | 9/2012 | Quaintance | B65D 5/2019 | 229/109 |
| 2010/0065621 | A1 | 3/2010 | Quaintance | | |

* cited by examiner

PACKAGING BOX, BLANK, METHOD AND APPARATUS FOR FORMING THE SAME

CROSS-REFERENCE TO PRIOR APPLICATION

This application is a § 371 National Stage Application of PCT International Application No. PCT/EP2014/073469 filed Oct. 31, 2014, which is incorporated herein in its entirety.

TECHNICAL FIELD

The present disclosure relates to a packaging box, and particularly to a packaging box which is able to provide curved edge portions. The present disclosure also relates to a contiguous blank for forming the packaging box, a method for forming the blank into the packaging box, and an apparatus for forming the packaging box from the blank.

BACKGROUND

Conventional packaging boxes, for example corrugated boxes or cardboard boxes, are typically in the form of a rectangular prism, sometimes termed "brick shape", having six rectangular or square faces, respectively two pairs of side walls and each of a top and bottom wall, defining an internal void for containing the packaged articles. While such rectangular forms may be efficient from the point of view of saving space, design possibilities are limited with conventional packaging boxes. Curved forms can be particularly attractive to customers, and can convey an impression of greater quality or luxury as compared with rectangular forms.

Although some packaging boxes having curved portions are known to exist in the art, many of these are difficult or expensive to fabricate and thus require more complex production methods and correspondingly lower efficiency in their production. Also, when such curved packaging boxes are constructed, a generally thicker material is needed to ensure both stacking strength and rigidity, but cracks and kinks easily appear when thicker material is forced into a curved shape. Curved packaging boxes of thinner material often are limited to specialist applications in which stacking strength is of relatively lesser importance.

Accordingly, there is a need for an improved packaging box having curved corners and edges. There is also a need for improved blanks from which the box can be formed, together with improved methods and apparatus for assembling the tubes and blanks into the box.

SUMMARY

According to a first aspect, there is provided a packaging box. The packaging box includes a base portion defining a first plane. The packaging box includes at least one first side wall portion. The at least one first side wall portion is arranged at an angle to the base portion. The first side wall portion is joined to the base portion via a fold line at a first edge of the base portion. The first side wall portion has an extension portion extending from one edge of the side wall portion so as to provide at least part of second side wall portion arranged at an angle to the base portion and at an angle to the first side wall portion. The second side wall portion includes at least part of the extension portion extending from the first side wall portion. A connecting portion of the extension portion connecting the first side wall portion to the second side wall portion is smoothly curved.

In one embodiment, the at least one first side wall portion is one of a pair of first side wall portions arranged at an angle to the base portion. Each of the first pair of side wall portions is joined to the base portion via a fold line at a first pair of opposite edges of the base portion. Each side wall portion of the first pair of side wall portions has a pair of extension portions extending from opposite sides of the respective side wall portions so as to provide at least part of the second pair of side wall portions arranged at an angle to the base portion and to the first pair of side wall portions. Each side wall portion of the second pair of side wall portions includes part of an extension portion extending from one side wall portion of the first pair of side wall portions. Each side wall portion of the second pair of side wall portions includes part of an extension portion extending from the other side wall portion of the first pair of side wall portions. A connecting portion of each extension portion connecting one side wall portion of the first pair of side wall portions to one side wall portion of the second pair of side wall portions is smoothly curved.

In one embodiment, the box includes a pair of side tab portions. The side tab portions are arranged perpendicular to the base portion. The pair of side tab portions are joined to the base portion via a fold line at a pair of opposite edges of the base portion such that each side tab portion lies against a surface of a respective extension portion of the extension portions.

In one embodiment, the side tabs define at least a part of the pair of second side wall portions.

In one embodiment, the pair of side tabs each extend to the same distance perpendicular to a base of the at least one first side wall portion.

In one embodiment, a surface of each of the side tabs is fixed to a surface of the respective extension portion.

In one embodiment, the box further includes at least one lid portion. The at least one lid portion is joined to one wall portion of the at least one first side wall portions and the second side wall portions via a fold line. The at least one lid portion extends at an angle to the respective side wall portion so as to at least partially close the packaging box.

In one embodiment, the lid portion is joined to one of the pair of side tab portions via a fold line.

In one embodiment, the lid portion extends as far as each of the first and second side wall portions.

In one embodiment, the lid is provided with a lid tab portion. The lid tab portion is joined via a fold line to an edge of the lid portion opposite to the fold line joining the lid portion and the first or second side wall portion from which the lid portion extends. The lid tab portion is arranged to lie against the first or second side wall portion opposite to the first or second side wall portion from which the lid portion extends.

In one embodiment, the box further includes at least one lid support portion. The at least one lid support portion extends from one of the first or second side wall portions which does not include the first or second side wall portion from which the lid portion extends. The at least one lid support portion is joined to the respective side wall portion via a fold line at an opposite end of the side wall portion to the base portion.

In one embodiment, the lid support portion extends from the at least first side wall portion.

In one embodiment, the lid support portion extends from one side wall portion of the pair of second side wall portions.

In one embodiment, the lid support portion extends from an edge of one of the side tab portions.

In one embodiment, the box further includes a pair of first lid portions. The first lid portions are joined to respective side wall portions of first or second side wall portions at edges of the side wall portions opposite to the base portion by respective fold lines and extending towards each other.

In one embodiment, the box further includes a pair of second lid portions. The second lid portions are joined to respective side wall portions of another of the pairs of first and second side wall portions at edges of the side wall portions by respective fold lines and extending towards each other so as to lie against the first pair of lid portions.

In one embodiment, the pair of first lid portions extends from the pair of first side wall portions.

In one embodiment, the pair of first lid portions extend from the pair of second side wall portions.

In one embodiment, the pair of first lid portions extend respectively from edges of the side tab portions.

In one embodiment, at least one of the at least one first side wall portion and the second side wall portions are perpendicular to the base.

According to a second aspect, there is provided a contiguous packaging blank for forming a packaging box. The blank includes a base portion. The blank includes a first side wall portion joined to the base portion via a fold line at a first end of the base portion. The first side wall portion has at least one extension portion extending from one side of the side wall portion and disconnected from the base portion. At least a connecting portion of the extension portion intermediate of the side wall portion and an end of the extension portion furthest from the side wall portion is able to be formed by bending into a smooth curve.

According to a third aspect, there is provided a method of forming a packaging box from a contiguous blank. The method includes a step of placing a forming element on the base portion of the blank. The method includes a step of folding the first side wall portion along the fold line to achieve an angle to the base portion. The method provides a step of bending the connecting portion around the forming element. At least one of the second pair of side wall portions is defined at least by part of the at least one extension portion.

In one implementation, the forming element includes a curved portion around which the connecting portion is bent.

In one implementation, the forming element is a product or products for being packaged in the packaging box.

According to a fourth aspect, there is provided an apparatus for forming a packaging blank into a packaging box. The apparatus includes a forming station. At the forming station, the blank in a flat state may be arranged in a first plane. The apparatus includes a forming means having an insert portion for insertion in a first direction perpendicular to the first plane. The insert portion has an insertion-direction surface in the insertion direction which corresponds to the base portion. The insert portion has an outer surface having support portions which correspond to portions of the interior surface of the packaging box when formed. The forming station has a plurality of guide surfaces surrounding a region for accommodating the base portion. The insert portion is arranged to move in the first direction into the region for accommodating the base portion. The plurality of guide surfaces are adapted to provide surfaces such that in a first stage of insertion, in which the insertion portion is inserted towards the base portion so as to displace the base portion into the region, a concave first guide surface is arranged facing the insertion direction so as to bend the connecting portion to a curved shape as the base portion progresses in the insertion direction. The plurality of guide surfaces are adapted to provide surfaces such that in a second stage of insertion, in which the insertion portion is inserted towards the base portion so as to displace the base portion further into the region, a second guide surface is arranged at a position relatively more inwardly toward the region for accommodating the base portion than the first guide surface so as to fold the at least one first side wall portion to an angle relative to the base portion as the base portion progresses in the insertion direction.

In one embodiment, the insert portion is arranged to accommodate one or more products which is to be packaged in the packaging box.

In one embodiment, the insert portion is arranged to retain a product which is to be packaged in the packaging box such that the product contacts the base portion during the insertion.

In one embodiment, the first guide surface has vertical portions arranged either side of a horizontal portion, connecting regions of the surface connecting the vertical portions to the horizontal portion being smoothly curved.

In one embodiment, the second guide surface has a convex portion oriented towards the region for accommodating the base portion.

In one embodiment, the first guide surface and the second guide surface are displaceable away from the region for accommodating the base portion so as to allow a finished box to be removed.

BRIEF DESCRIPTION OF THE DRAWINGS

For a better understanding of embodiments of the present invention and to show how the same may be carried into effect, reference will be made, by way of example only, to the accompanying drawings, in which.

DETAILED DESCRIPTION OF PARTICULAR EMBODIMENTS

Figure 1:
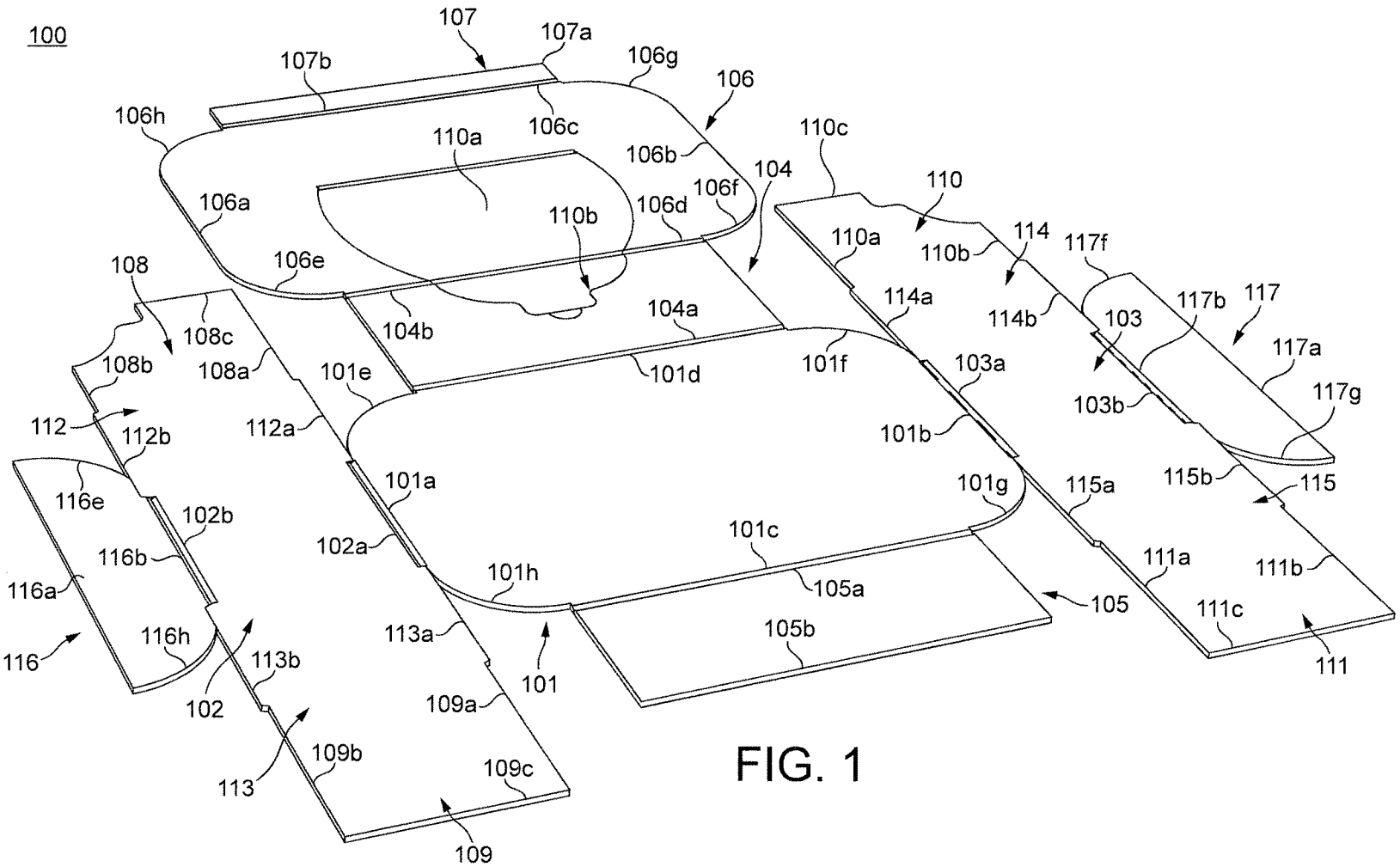
FIGS. 1 to 8 show an implementation of a method of assembling a packaging box from a blank according to a first embodiment.

FIG. 1 shows a packaging blank 100 suitable for folding into a packaging box 200 according to an embodiment.

Packaging blank 100 has a generally planar form, and is formed of a single sheet of foldable and flexible material.

The packaging blank 100 of FIG. 1 has several principal portions.

Base portion 101 is provided having a generally rectangular shape with rounded corners. Base portion 101 has two pairs of opposite straight edges 101*a*, 101*b* and 101*c*, 101*d*, each of which is connected to another portion via a fold line. Joining straight edges 101*a*, 101*b*, 101*c* and 101*d* are curved edges 101*e*, 101*f*, 101*g* and 101*h* which provide the mentioned rounded corners.

One pair of opposite end edges 101*a*, 101*b* are connected to a respective pair of first side wall portions 102 and 103, via fold lines at corresponding edges 102*a* and 103*a*. First side wall portions 102 and 103 have a width in a direction parallel to edges 102*a*, 103*a*, corresponding to the width in the same direction of respective edges 101*a*, 101*b*. From either side of first side wall portions 102, 103, in a direction parallel to edges 102*a*, 103*a*, on each side are extension portions formed of connecting portions 112, 113, 114, 115 and second side wall portions 108, 109, 110 and 111.

Connecting portions 112, 113, 114 and 115 have respective first edges 112*b*, 113*b*, 114*b* and 115*b*. Connecting portions 112, 113, 114 and 115 have respective second edges 112*a*, 113*a*, 114*a* and 115*a* which are arranged opposite to and running parallel to the first edges. Second side wall portions 108, 109, 110 and 111 have respective first edges 108*b*, 109*b*, 110*b* and 111*b*. Second side wall portions 108, 109, 110 and 111 have respective second edges 108*a*, 109*a*, 110*a* and 111*a* which are arranged opposite to and running parallel to the first edges. No fold lines are provided between first side wall portions 102, 103 and corresponding connecting portions 112, 113, 114, 115, or between connecting portions 112, 113, 114, 115 and corresponding second side wall portions 108, 109, 110, 111.

Extending from base portion 101, at opposite edges 101*c* and 101*d*, which are arranged opposite each other in a direction perpendicular to opposite edges 101*a* and 101 *b* in the plane of base portion 101 and joined to base portion 101 by respective fold lines are side tab portions 104, 105. Side tab portion 104, in the present embodiment, extends to the same distance from edge 104*a* at which it joins base portion 101 as first side wall portions and second side wall portions extend from respective edge portions 102*a*, 103*a* at which the first side wall portions respectively join base portion 101. However, second side tab portion 105 extends to edge 105*b* opposite edge 105*a* at which it joins base portion 101 slightly less far than tab portion 104 extends, although in other embodiments, side tab portions 104, 105 can extend as far as each other from base portion 101.

Provided on edge 104*b* of side tab portion 104 opposed to edge 104*a* at which side tab portion 104 joins base portion 101, and joined to side tab portion 104 at a fold line is lid portion 106. Lid portion 106 has a substantially similar shape, or, in some embodiments, the same shape, as base portion 101. Lid portion 106 has straight edges 106*a*, 106*b*, 106*c* and 106*d*. At edge 106*c*, which is opposite to edge 106*d* at which lid portion 106 is joined to side tab portion 104, is lid tab portion 107. Lid tab portion 107 is, in the present embodiment, generally rectangular, and has an extent in a direction away from edge 107*b* at which lid tab portion 107 joins lid portion 106 which is equal to the difference in the extent of side tab portion 104 away from edge 104*a* at which side tab portion 104 joins base portion 101 and the extent of side tab portion 105 away from edge 105*a* at which side tab portion 105 joins base portion 101. Joining the respective straight edges of lid portion 106 are curved edges 106*e*, 106*f* 106*g*, and 106*h*, which correspond to curved edges 101*e*, 101*f*, 101*g* and 101*h* of base portion 101.

Extending from edges 102*b* and 103*b* of first side wall portions 102, 103 are lid support portions 116 and 117. Lid support portions 116 and 117 have two parallel straight edges 116*a* and 116*b* and 117*a*, 117*b*, each, respectively, and two curved wall portions 116*e*, 116*h* and 117*g*, 117*f*, respectively, which have a curved form of the same shape as corresponding curved portions 101*e*, 101*h*, 101*f* and 101*g*, respectively, of base portion 101, which define the rounded corners of the generally rectangular base portion 101. Particularly, curved corner portion 101*e* joins edge 101*a* with 101*d*; curved corner portion 101*f* joins edge 101*d* with edge 101*b*; curved corner 101*g* joins edge 101*b* with 101*c*; and curved corner portion 101*h* joins edge 101*c* with edge 101*a*.

While edges 116*a* and 117*a* of lid support portions 116, 117 are shown to be straight, edges 116*a* and 117*a* may not be straight, but may instead be curved or shaped otherwise than shown in FIG. 1.

In the embodiment of FIG. 1, lid portion 106 is provided with aperture 110*a* extending from edge 106*d* of lid portion 106, which adjoins with the corresponding aperture 110*b* formed in side tab portion 104 extending from edge 104*b*. Each of portions 108, 110 have in respective upper edges 108*b* and 110*b* a cut-out portion adapted to have a corresponding shape to one half or less of the cut-out portion formed in edge 104*b* of side tab portion 104. This is able to facilitate the use of aperture 110*b* for viewing or accessing contained products. The provision of such an aperture is optional, but in the embodiment of FIG. 1, the aperture is provided with a transparent film covering, the purpose of which will be explained later. In another configuration, the aperture is formed by perforation or weakening of the material from which lid portion 106 and side tab portion 104 are made along a line defining the aperture, so as to enable the aperture to be opened by tearing the material along the perforated or weakened line.

Blank 100 shown in FIG. 1 may be assembled into a packaging box by the process shown in FIGS. 2-8.

Figure 2:
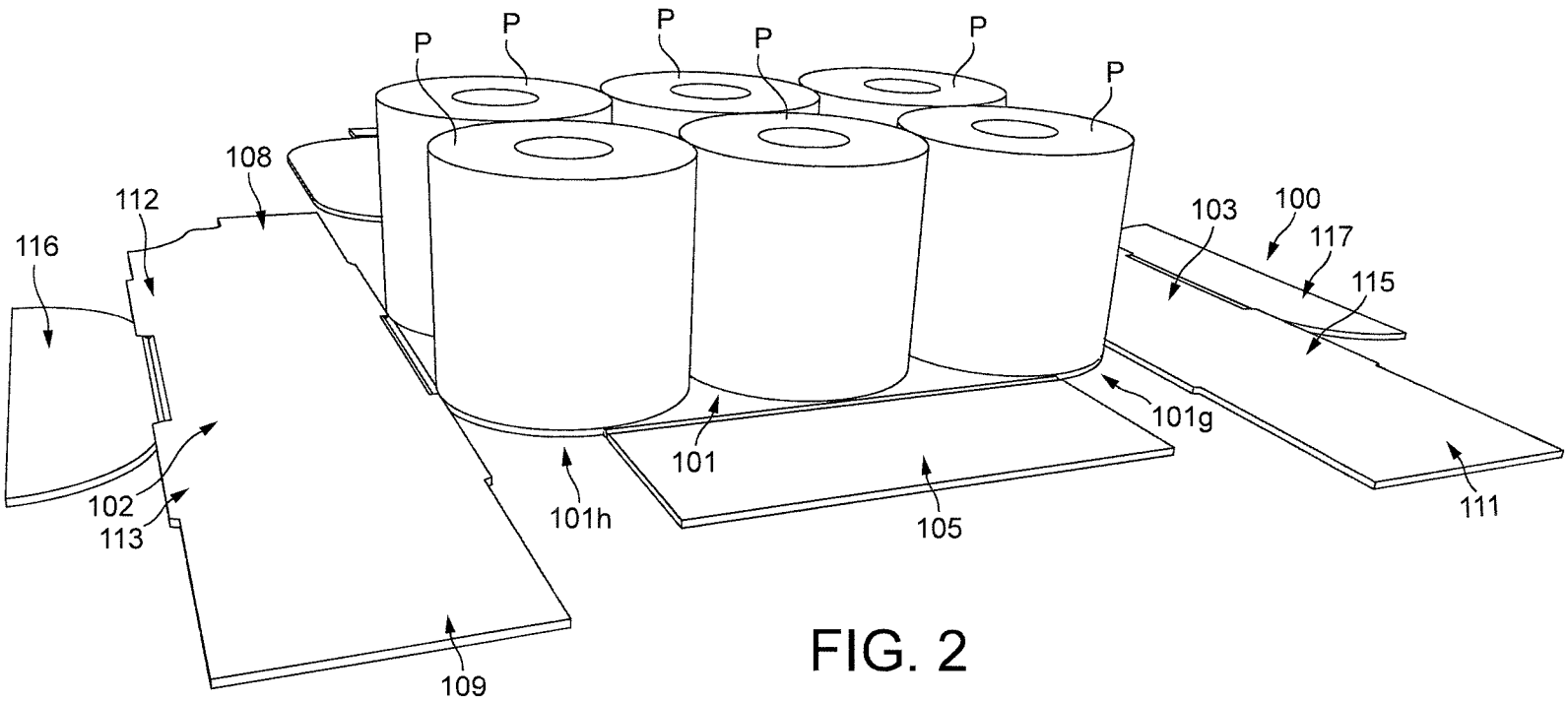

In FIG. 2, products P are placed on base portion 101. The shape, and more particularly the radius of curvature, of curved edges 101*e*, 101*f*, 101*g* and 101*h* of base portion 101 are selected to match or to correspond to an outer surface shape of products P. However, this is optional, and the shape or radius of curvature of curved edges 101*e*, 101*f*, 101*g* and 101*h* may be selected for other reasons, such as structural reasons. However, selecting the shape of curved edges 101*g*, 101*h*, 101*e* and 101*f* to correspond to the outer shape of product P allows an assembly method wherein the packaging blank 100 is assembled into packaging box 200 with the product already arranged on base portion 101, the product P then providing additional support to the side walls during the assembly process.

Figure 3:
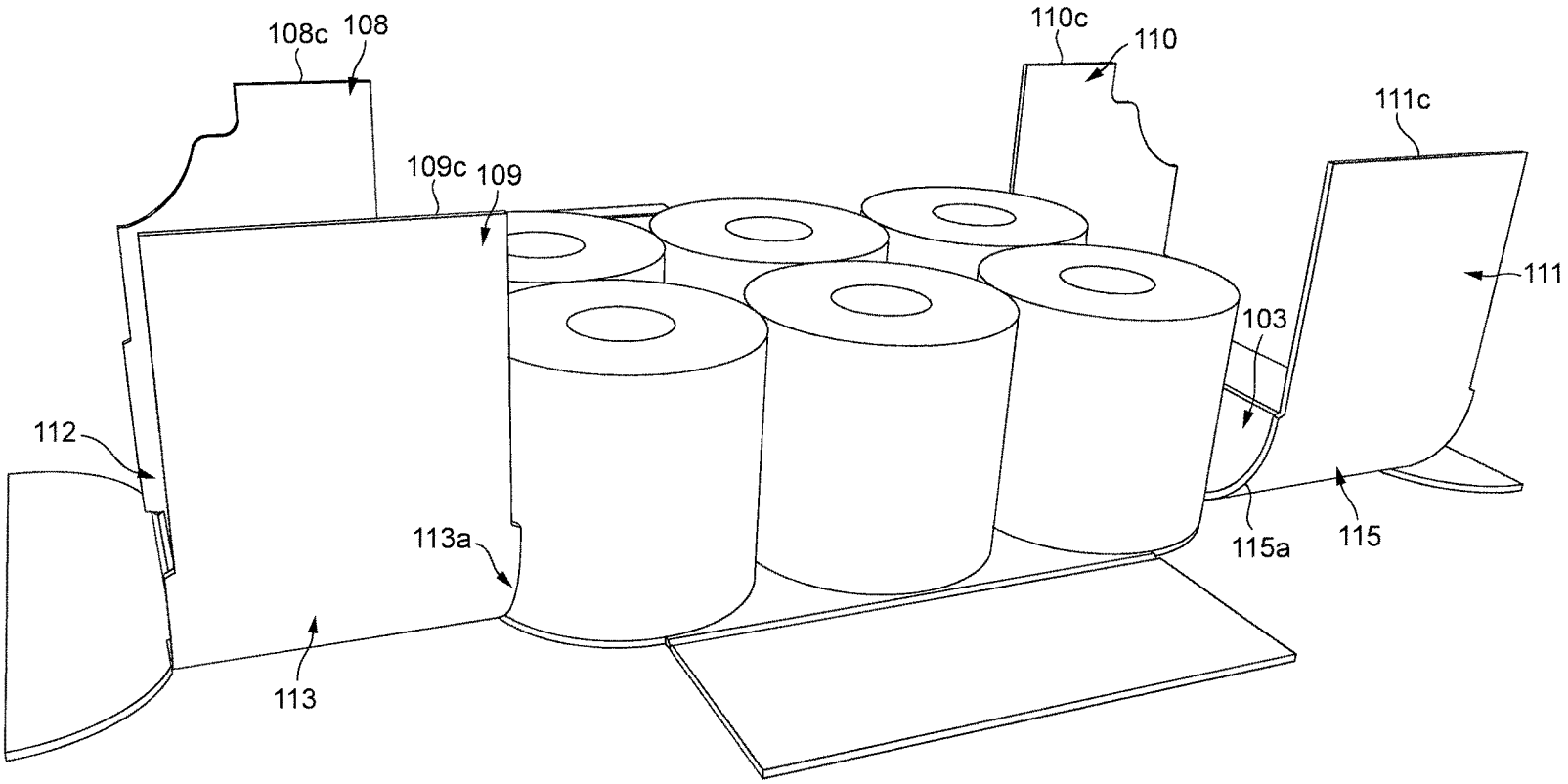

In FIG. 3, edges 108*c*, 109*c*, 110*c* and 111*c* of respective second side wall portions 108, 109, 110 and 111, which are edges which are furthest from respective first side wall portions 102 and 103 are raised up from the plane of base portion 101 until second side wall portions 108, 109, 110 and 111 are perpendicular to base portion 101 and are all mutually parallel, second side wall portions 108 and 110 being coplanar, and second side wall portions 109, 111 also being coplanar. Connecting portions 112, 113, 114 and 115 are curved, such that the shape, and particularly the radius of curvature of respective edges 112*a*, 113*a*, 114*a* and 115*a*, at which connecting portions 112, 113, 114 and 115 approach respective curved edges 101*e*, 101*h*, 101*f* and 101*g* of base portion 101, correspond in shape, and particular in radius of curvature, to edges 101*e*, 101*h*, 101*f* and 101*g*, respectively.

Figure 4:
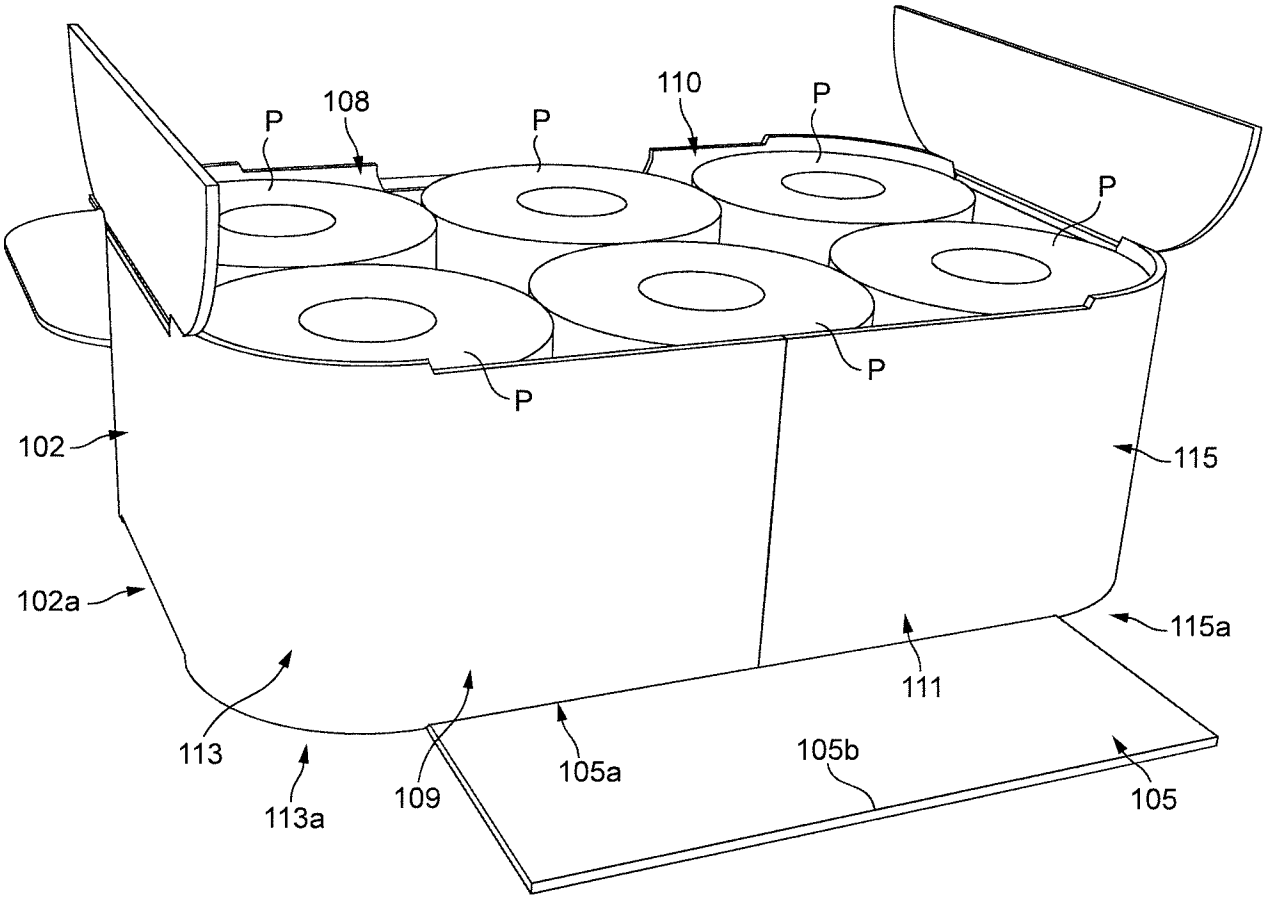

As shown in FIG. 4, from the position shown in FIG. 3, respective first side wall portions 102 and 103 are raised about fold lines adjoining edges 102*a* and 103*a* so as to be perpendicular to base portion 101 and to be mutually parallel. By the correct choice of the shape, and particularly the radius of curvature, of connecting portions 112, 113, 114, 115, and particularly of edges 112*a*, 113*a*, 114*a* and 115*a*, when the configuration of FIG. 4 is reached, edges 113*a*, 114*a*, 115*a* and 116*a* follow respective curved edges 101*g*, 101*h*, 101*e* and 101*f* of base portion 101. Also, if the shape, and particularly the radius of curvature, of edges 112*a*, 113*a*, 114*a* and 115*a* are appropriately selected, connecting portions 112, 113, 114 and 115 conform to the outer shape of products P. Further, since second side wall portions 108, 110, 109 and 111 were arranged to be parallel in FIG. 3, when the configuration of FIG. 4 is achieved, this parallel condition is retained and second side wall portions 109, 111 form one of a second pair of side walls of the packaging box while second side wall portions 108, 110 form the other of the second pair of side walls. Each of the second pair of side walls formed by side wall portions 108, 110 and second side wall portions 109, 111 are planar and parallel to the other.

Figure 5:
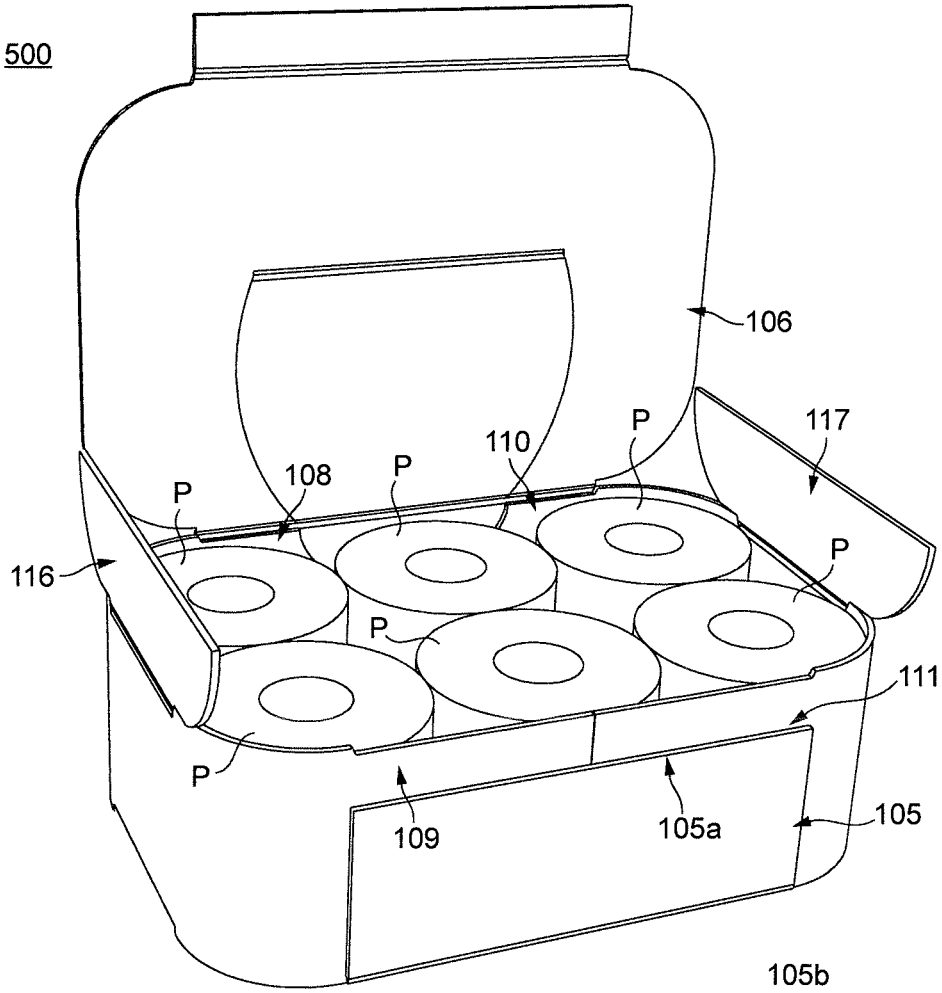

FIG. 5 shows the configuration of FIG. 4 after side tab portions 104 and 105 are lifted at edges 104*a* and 105*a* so that side tab portions 104 and 105 are perpendicular to base portion 101 and are mutually parallel. As can be seen from FIG. 5, second side wall portions 108, 109, 110 and 111 do not, as such, need to extend the full length of the respective ones of the pair of second side walls, namely, they do not need to meet in the middle of the side walls or to overlap. Instead, as can be seen from FIG. 5, provided that side tab portions 104 and 105 have sufficient extent away from base portion 101, any gap between corresponding second side wall portions 109 and 111, on the one hand, and corresponding second side wall portions 108, 111 on the other hand, can be covered by tab portions 104 and 105, which then define part of the respective second pair of side walls.

In the configuration of FIG. 5, it is possible for adhesive or another fastening means to be applied to secure side tab portions 104, 105 against respective second side wall portions 108, 109, 110 and 111, as appropriate, to provide structural integrity to the packaging box as shown in FIG. 5. Notably, as shown in FIG. 5, the packaging blank 100 is now substantially assembled into packaging box 200, since, if the product P has not, at the point of FIG. 5, yet been loaded into packaging box 200 formed from packaging blank 100, it is at the stage of FIG. 5 that the product may be placed into packaging box 200.

Furthermore, for some applications, it is possible that lid portion 106 and/or lid support portions 116, 117 are not required, and that a separate lid, film wrap, or other covering might be provided. Therefore, depending on the packaging approach to be adopted, assembly may finish at the configuration shown in FIG. 5.

In the depicted embodiment, the lid portion 106 is not attached to the edges of the side wall portions which are to be elevated and curved, but extends from, for example, side tab portion 104. Such a configuration may have advantages in terms of assembly as described above or by the apparatus as described below since the presence of the lid portion will not tend to shift the centre of gravity of the blank, in at least the lateral direction from edge 101*d* to 101*c* of base portion 101, from the centre of gravity of the base portion in this direction when the sidewall portions are simultaneously elevated out of the plane of the blank. Therefore, the step of elevating the side wall portions 102 and 203 is carried out in a manner substantially unencumbered by the weight of lid portion 107, even when lid portion 107 may be of substantial extent and weight. Such an approach thus leads to an improvement in handling ease for these side wall portions.

Figure 6:
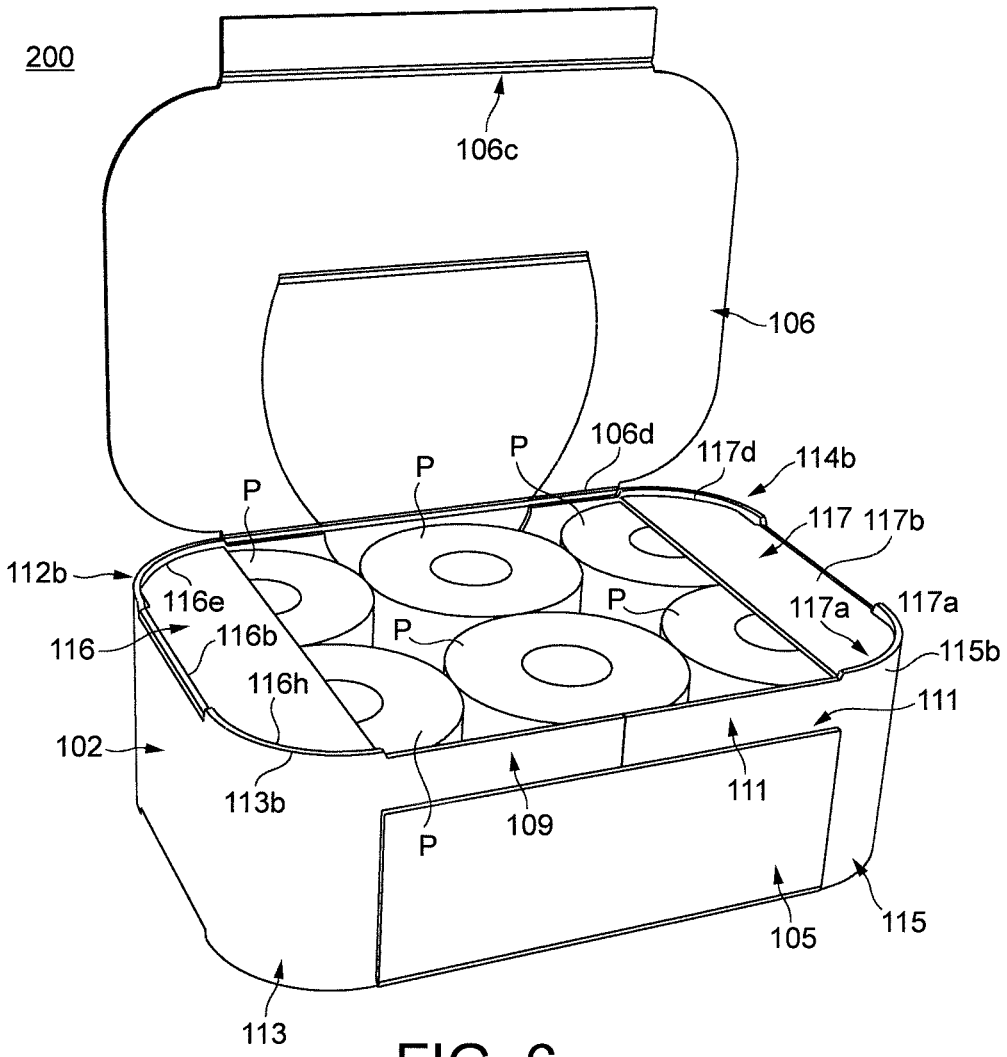

In some implementations, however, the handling of packaging box 200 shown in FIG. 5 may be continued, to the state shown in FIG. 6. In FIG. 6, lid support portions 116, 117 have been folded about fold lines adjacent to edges 116*b* and 117*b* at which lid support portions 116, 117 are joined to first side wall portions 102, 103, such that lid support portions 116, 117 are parallel to base portion 101. If the extent of first and second side wall portions away from base portion 101 has been appropriately chosen, lid support portions 116, 117 may lie on top of product P. Also, if curved edges 116*e*, 116*h*, 117*f* and 117*g* have been appropriately selected to conform to the curvature of respective edges 112*b*, 113*b*, 114*b* and 115*b* of respective connecting portions 112, 113, 114 and 115, edges 116*e*, 116*h*, 117*f* and 117*g* of lid support portions 116, 117 lie against the inner surfaces of connecting portions 112, 113, 114 and 115, thereby to provide additional structural support to the smooth curvature of connecting portions 112, 113, 114 and 115.

In this regard, it is helpful if connection portions 112, 113, 114, 115 have an extent away from base portion 101 which is slightly greater than that of first side wall portions 102, 103 and second side wall portions 108, 109, 110 and 111, and also that connection portions 112, 113, 114 and 115 in the configuration shown in FIG. 6 extend slightly below the plane of base portion 101, to facilitate the contact of edges 116*e*, 116*h*, 117*f*, 117*g* on the lid side and edges 101*e*, 101*h*, 101*f* and 101*g* on the base side with the respective inner surfaces of connection portions 112, 113, 114 and 115, to further improve structural support and rigidity.

Figure 7:
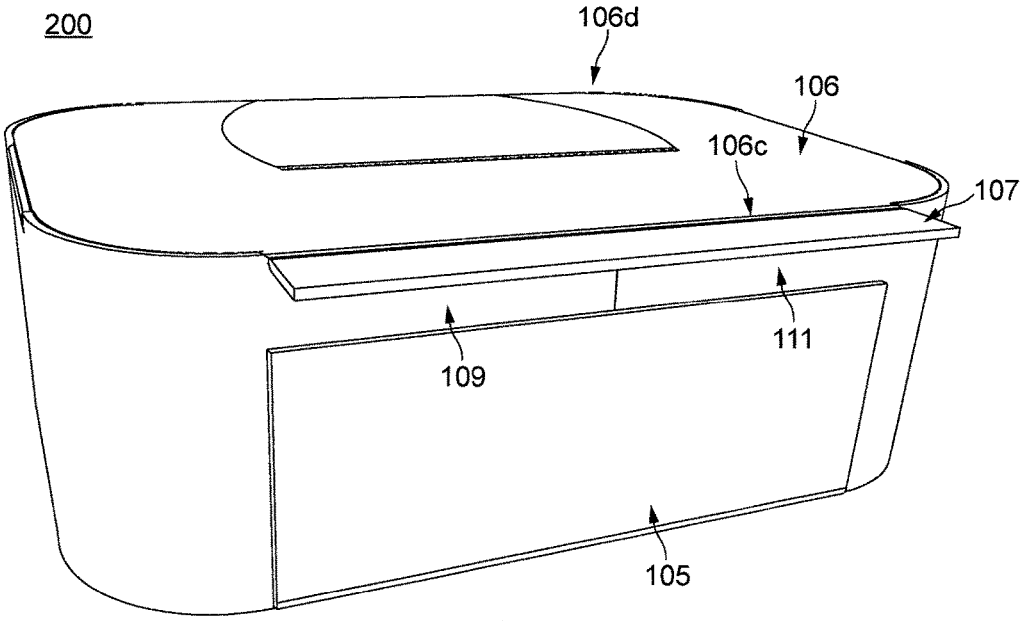

FIG. 7 shows a further step in the assembly of packaging box 200 achievable from the step of FIG. 6. In the step of FIG. 7, edge 106*c* opposite to edge 106*d* at which lid portion 106 joins side tab portion 104 is lowered to approach and to lie against edges 109*b* and 111 *b* of respective second side wall portions 109 and 111 which are furthest from base portion 101. Thereby, a void defined within packaging box 200 is enclosed.

Also in the state shown in FIG. 7, lid portion 106 lies against lid support portions 116, 117. It is possible for adhesive or another fixing means to be provided between contact surfaces of lid portion 106 and lid support portions 116, 117, to maintain the lid portion parallel to base portion 101.

Figure 8:
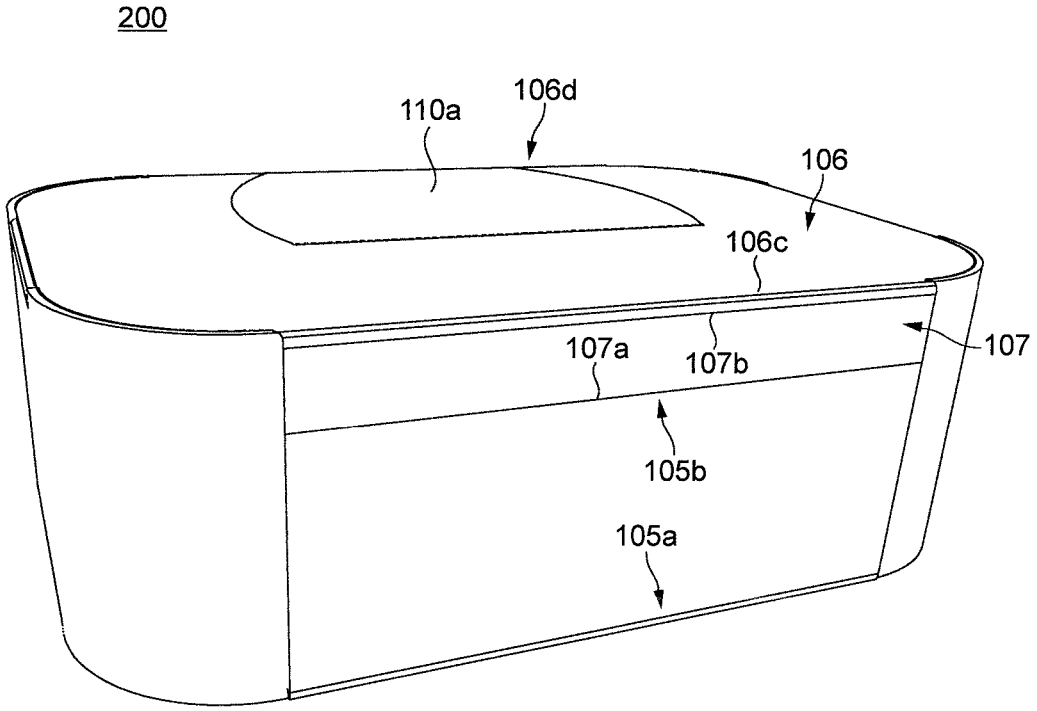

Finally, as shown in FIG. 8, lid tab portion 107 may be folded about the fold line connecting edge 107*b* of lid tab portion 107 with edge 106*c* of lid portion 106 which opposes edge 106*d* at which lid portion 106 is connected to side tab portion 104. Tab portion 107 is folded down to lie against second side wall portions 109, 111 and may contact or overlie side tab portion 105 where edges 107*a* and 105*b*, respectively of lid tab portion 107 and side tab portion 105, approach, adjoin or overlie. Adhesive or another fixing means may be provided between lid tab portion 107 and second side wall portions 109, 111, to secure tab portion 107 in place, thereby to improve the rigidity and structural stability of box 200.

The function of apertures 110*a* and 110*b* as shown in FIG. 1 and also in FIG. 8 is to provide a window through which the products in the box may be observed or handled, and their type, quantity and proper arrangement can be identified. However, such windows or apertures may be absent, may be provided to be formed by the user by perforating or otherwise weakening the perimeter of the aperture so as to enable it to easily be torn or cut, or may be alternatively totally open or may be covered with suitable transparent material, such as transparent plastic film.

The assembling process shown in FIGS. 2 to 8 may be carried out manually or in an automated process. In one automated process, an apparatus provided with robotic arms having suction cups or other grippers arranged thereon can be used to bend and shape material about the product or another suitably-shaped insert. Such an apparatus minimally may provide a means for arranging a product unit or a correspondingly-shaped forming insert at a suitable location on a blank positioned at a forming station, and a set of robotic arms adapted to grip and fold the various portions around the insert or product. Optionally, a further robotic arm or conveyor can be used to translate the formed box away from the forming station.

Of course, a number of variations on packaging blank 100 and packaging box 200 may be considered, and the various constructions, dimensions and configurations disclosed herein may be varied.

Particularly, the dimensions of the various portions of packaging blank 100 and packaging box 200 may be varied, depending on requirements. For example, it is not necessary for base portion 101 and/or lid portion 102 to fully cover the respective bottom and top of the packaging box 200. If the base portion 101 and lid portion 106 are formed with a cross-type structure, having inwardly rather than outwardly curved edges 101*g*, 101*h*, 101*e*, 101*f* and 106*g*, 106*h*, 106*e*, 106*f*, then the packaging box will still retain the product provided the product has a certain minimum dimension so as not to drop between the gaps between the connecting portions 112, 113, 114, 115 and lid portion 106 or base portion 101.

Furthermore, the dimensions of the various side wall portions may be varied, and, for example, second side wall portions 108, 109, 110 and 111 may extend only a short way along the length of the second pair of side walls 108, 109, 110 and 111, the majority of the material of the second pair of side walls 108, 109, 110 and 111 being provided by side tab portions 104, 105. Alternatively, and especially in configurations where no lid portion 106 is present, side tab portions 104 and 105 may only extend a fraction of the extent of second side wall portions 108, 109, 110 and 111 away from base portion 101, as may be preferred.

Also possible is a pallet-type box, in which the extent of connecting portions 112, 113, 114 and 115 from base portion 101 is much greater than that of first side wall portions 102, 103, second side wall portions 108, 109, 110 and 111, and side tab portions 104, 105. Such a configuration then provides essentially a base portion having connecting portions 112, 113, 114 and 115 arranged to hold the product in place, but having pairs of first and second side walls 108, 109, 110 and 111 which are only a fraction of the height of connecting portions 112, 113, 114 and 115. In such a configuration, the connecting portions 112, 113, 114 and 115 serve to hold the product in place, while the first and second pairs of side walls 108, 109, 110 and 111 and the side tab portions serve to retain the connecting portions 112, 113, 114 and 115 appropriately perpendicular to base portion 101, to retain product P in position. Such a pallet-type box can then be wrapped with film or can be covered by a separate lid.

Also contemplated, but not depicted in the Figures, is an alternative configuration wherein lid tab portion 107 is absent, lid portion 106 only extends halfway across the lid surface of the packaging box, and a corresponding lid portion is provided extending from edge 105*b* of side tab portion 105, which is, in this embodiment, of the same extent from base portion 101 as side tab portion 104. In such a configuration, the two lid portions, each respectively extending from one of the side tab portions 104, 105, approach, meet or overlie in the middle of the lid of the box, supported from lid support portions 116, 117.

Figure 21A:
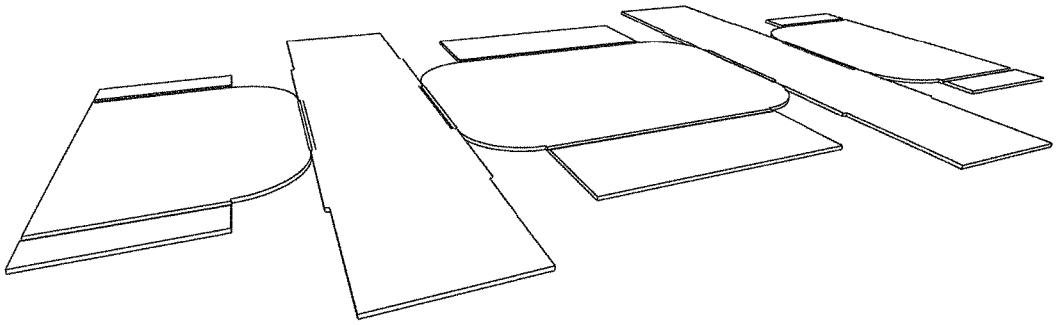
FIGS. 21A and 21B, respectively, show an alternative configuration of blank and box, respectively.
Figure 21B:
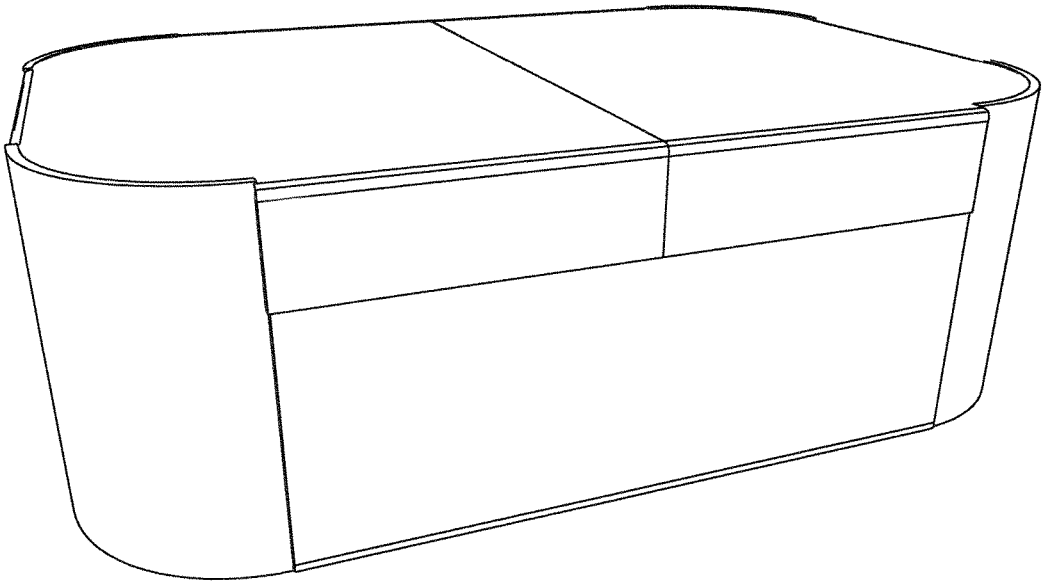

In a further alternative configuration, such lid portions may only extend a small way across the lid of the packaging box, or may be absent, while lid support portions 116, 117 are extended so as to have sufficiently great extent away from respective first side wall portions 102, 103, such that edges 116*a* and 117*a* of lid support portions 116 and 117, which oppose edges 116*b* and 117*b* at which lid support portions 116, 117 join first side wall portions 102, 103, respectively approach, adjoin or overlie, for example so as to interlock. Such a configuration is shown in FIGS. 21A and 21B. In such a configuration, the lid support portions in actuality provide a lid surface, while the lid portions 106 extending from side tab portions 104, 105 could be completely omitted, or could be arranged to underlie portions 116, 117 so as to provide support or a second thickness of material across the top of the box. In some variants, a lid support portion may extend from the side wall portion opposite to the side wall portion from which the lid extends.

In the disclosed configuration, the lid support portions are of symmetrical extent away from the edges of the side wall portions from which they extend. Such a configuration may have advantages in terms of assembly as described above or by the apparatus as described below since portions having symmetrical extent will not tend to shift the centre of gravity of the blank, in at least the lateral direction from edge 101*a* to 101*b* of base portion 101, from the centre of gravity of the base portion in this direction when the sidewall portions are simultaneously elevated out of the plane of the blank. Additionally, since in some variants, especially those not having lid portion 107, the weight of the lid support portions in aggregate is shared between the lid support portions, the entire aggregate weight is not borne by either of side wall portions 102, 103 individually. Dividing the weight of the lid support leads to an improvement in handling ease for these side wall portions, especially when the side wall portions 102, 103 are to be curved and then raised out of the plane of the blank.

The configuration shown in FIGS. 1 to 8 is generally cuboidal, but having rounded corners. Thus, it is similar to the known brick-shaped packages in terms of ability to be stacked and arranged. However, a number of variants on such a design are possible which are not generally cuboidal, as will now be explained.

Firstly, as may be understood by considering FIG. 1, the first pair of edges 101*c*, 101*d* of base portion 101 need not be parallel and the first side wall portions 104 and 105 need not be parallel. By making side wall portions 104 and 105 non-parallel, a wedge-shaped box can be obtained. If an axis of symmetry lying between the side wall portions 104 and 105 is retained, then the boxes will be particularly easy to tessellate, and thus will be able to save space when packed together in a layer. The same is true for the second pair of edges 101*c*, 101*d* and second side wall portions 102 and 103, which also need not be parallel.

Next, the side wall portions 102, 103, 104, 105 need not be raised to be perpendicular to base portion 101. Rather, the side wall portions could be raised to an angle greater or lesser than the angle perpendicular to the base portion 101, so as to lean inwardly or outwardly, such that a box which tapers toward the top or base may be created. Side walls 102, 103 and side walls 104, 105, respectively, may be angled to lean in the same or opposite directions, for example so that a box which has the shape of a parallelepiped may be formed.

Further, lid portion 106 need not be parallel to base portion 101. In such a case, it may be required that the top and base edges of the various side wall portions are not parallel or may have different heights. Such a configuration may be useful for displaying products through the window 110*a* even when the box is arranged at or just below eye level, for example when lid portion 106 slopes such that side wall portion 104 is shorter than side wall portion 105.

Next, although the box described in connection with FIGS. 1 to 8 has a long axis arranged to run through side wall portions 102 and 103 above edges 101*a* and 101*b*, the box may have a shorter axis running in this direction instead. The relative dimensions of all the various portions are fully within the choice of the skilled person.

Even further, not all four corners of the box described in connection with FIGS. 1 to 8 need be curved. One or more of the corners may be formed to have a fold line and thus an angle.

Additionally, not all side wall portions need be provided. By omission of, for example, one side wall portion, an aperture may be provided, or a triangular base plan configuration can be adopted.

Further, more than four side wall portions can be provided, such that a five-sided or more-than-five-sided general plan can be provided.

Many other variations and modifications will occur to the person skilled in the art on the basis of the foregoing disclosure, and the skilled person in the art would recognise that the various elements of the packaging blank 100 and the packaging box 200 may be appropriately modified, substituted or omitted to fulfil particular configurations of box. All such configurations are considered to fall within the scope of the present disclosure.

It is also possible to provide an automated or machine-assisted process for the formation of packaging blank 100 shown in FIG. 1 into packaging box 200 shown in FIG. 6, as will now be explained with reference to FIGS. 9-20.

Figure 9A:
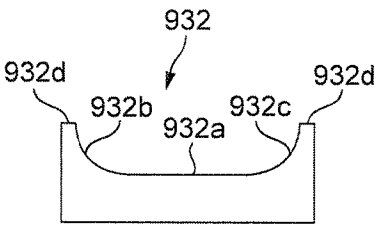
FIGS. 9 to 20 show an alternative embodiment of a method for assembling a packaging box from a packaging blank, via an automated process.
Figure 9B:
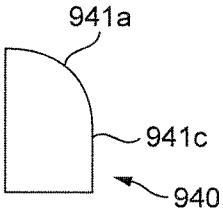
Figure 9:
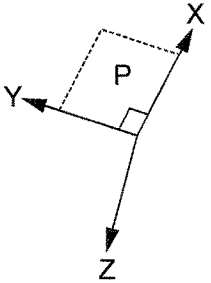
Figure 9:
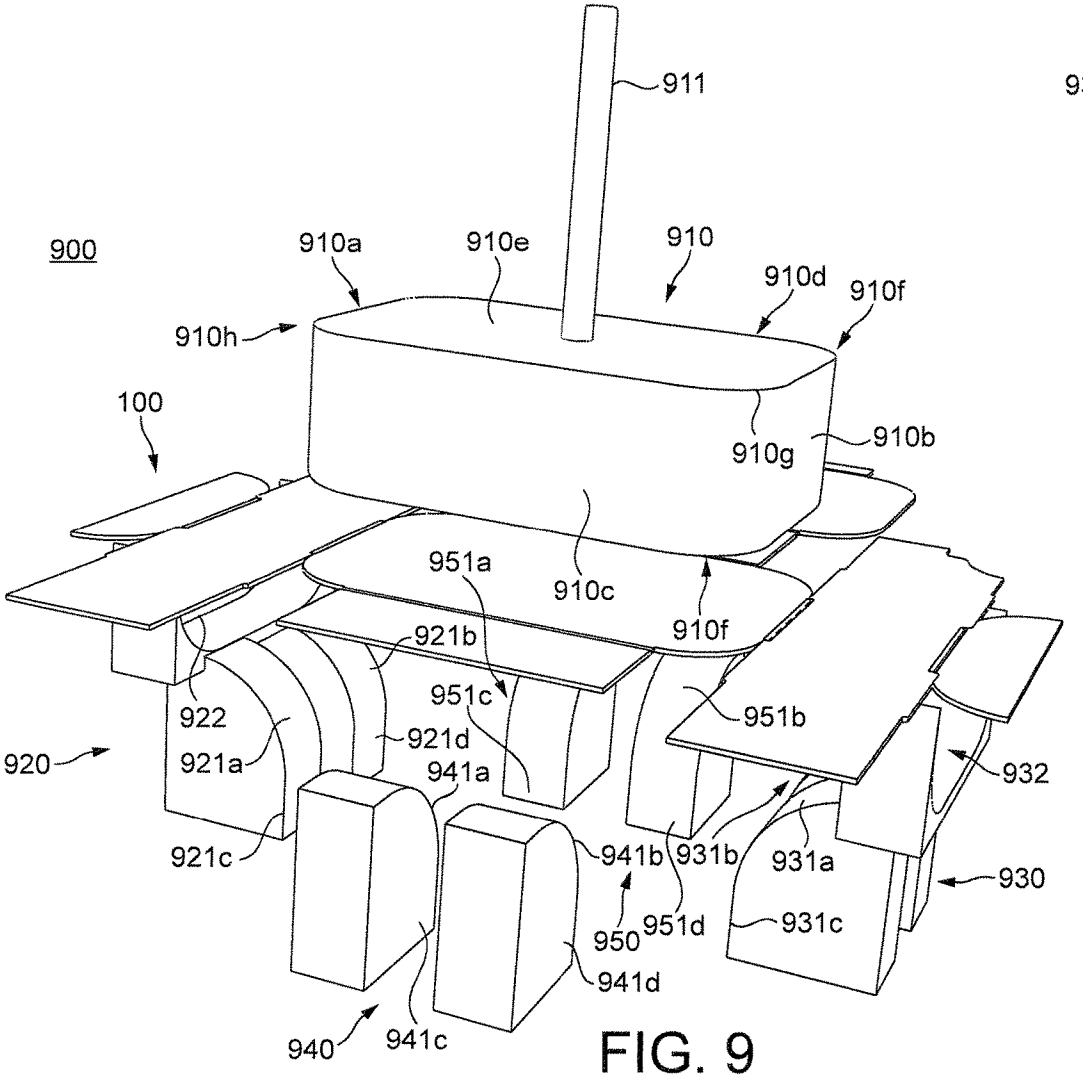

In FIG. 9, an apparatus 900 for automatically or assistedly assembling a packaging blank into a packaging box is shown. Particularly, apparatus 900 will be described with reference to an imaginary plane P which is a plane defined as the intended plane for the base wall of the packaging box. With reference to this plane, three orthogonal axes are considered, perpendicular x and y direction axes, which together define plane P, and direction axis z perpendicular to each of x and y axes, defining a normal to the plane P.

In the configuration of FIG. 9, the z-axis extends in the opposite direction of the elevation of the side walls of the finished box, in a direction perpendicularly down from the base surface.

Assembly apparatus 900 includes five principal working parts. Firstly, a first pair of forming guides 920, 930 is provided. The first pair of forming guides 920, 930, each provides a forming surface 921, 931, which is respectively directed towards a central space between the forming guides 920, 930. Forming surface 921 is, in the configuration of FIG. 9, divided by a vertical gap into two discrete portions, but could also be provided as a contiguous and integral surface. The forming surface 921 has a lower forming surface, arranged vertically, that is in the x-z plane, arranged to face lower forming surface 931*d* of forming guide 930 across the space. Extending vertically from a top, that is, negative-z-direction end of each of lower forming surface 921*c* and 921*d* is upper forming surface 921*a* and 921*b*, respectively, which curves convexly from a vertical orientation to a horizontal orientation away from the space between the first pair of forming guides 920, 930. Forming guide 930 has corresponding lower and upper forming surfaces 931*c*, 931*d* on the one hand and 931*a*, 931*b* on the other hand. Therefore, these surfaces together tend in the negative z-direction toward a single common plane parallel to the x-y plane. The opposing lower forming surfaces of the first pair of forming guides 930, 920 are spaced apart, across the space, by a distance which corresponds to the length of base portion 101 from edge 101*a* at which one side wall portion of the first pair of side wall portions is provided, to edge 101*b*, where the other side wall portion of the first pair of side wall portions is provided.

Arranged at the top, that is, negative z-direction end of the forming surfaces 921, 931 for each of the first pair of forming guides 920, 930, is a second forming surface 922, 932. The second forming surface has a central portion 922*a*, 932*a* which is parallel to the x-y plane and has a width equivalent to the width of each of the first pair of side wall portions 102, 103 in a direction along edges 101*a*, 101*b*, in other words, having length corresponding to the length of edges 101*a*, 101*b*. This width is measured in the x-direction, which is the direction in the x-y plane perpendicular to the direction which the lower first surfaces 921*c*, 921*d* and 931*c*, 931*d* face. At each end of surfaces 922*a*, 932*a* in the x-direction, respective upwardly-curved surfaces 922*b*, 922*c*, 932*b*, 932*c* are provided, which smoothly curve from a horizontal in the x-y plane to a vertical in the y-z plane. The curvature of these surfaces corresponds to the intended curvature of connecting portions 112, 113, 114 and 115 in blank 100 and box 200. At the highest point of surface 922, 932, that is, the furthest extent in the negative z-direction, flat end surfaces 922*d* and 932*d*, are provided, which all lie in a common plane parallel to the x-y plane. Forming elements 920, 930 are essentially identical, and arranged to face each other directly across the space.

Notably, the central portion 922*a*, 932*a* of the second forming surface can in this configuration be considered as an extension of the horizontal upper forming surface 921*a* and 921*b* in a direction away from the space.

Also provided in the assembly device 900 of FIG. 9 are a second pair of forming guides 940, 950, which have a similar configuration to the first pair of forming guides 920, 930 except that upper forming surface 932 is not provided. The second pair of forming guides 940, 950 therefore only provides opposing lower second forming surfaces 941*c*, 941*d* and 951*c*, 951*d*, and upper first forming surfaces 941*a*, 941*b*, and 951*a*, 951*b*. Further, upper forming surfaces 941*a*, 941*b*, 951*a* and 951*b* of second forming guides 940, 950 are arranged slightly lower, i.e., further in the positive z-direction, to the corresponding surfaces of the first pair of forming guides 920, 930. This can be provided by making forming guides 940, 950 similarly to forming guides 920, 930, except without second forming surfaces 922, 932, and positioning them relatively lower, that is, in the positive z-direction, than the first pair of forming guides 930, 920. Alternatively this can be provided by making lower second forming surfaces 941*c*, 941*d*, 951*c*, 951*d* relatively shorter in the z-direction and then arranging bottom surfaces of the first and second pair of forming guides on a common plane.

The second pair of forming guides 940, 950 are, like the first pair of forming guides 920, 930, arranged to face each other across the space between the first pair of forming guides 930, 920, but are arranged to face each other in the direction perpendicular to the facing direction of the first pair of forming guides 920, 930, namely in the x-direction in FIG. 9. Further, the spacing between lower first forming surfaces 941*c*, 941*d* on the one hand and lower first forming surfaces 951*c*, 951*d* on the other hand is set to correspond to the distance between edges 101*d* and 101*c* of base surface 101 in the packaging blank 100 of FIG. 1, being the edges at which side tab portions 104 and 105 adjoin base portion 101.

Accordingly, with the geometry of FIG. 9, finished box 200 can fit precisely between the lower first forming surfaces 921*c*, 921*d*, 931*c*, 931*d*, 941*c*, 941*d*, 951*c*, 951*d* of the first and second pair of forming guides 920, 930, 940 and 950.

Also part of the assembly device 900 is forming element 910. Forming element 910 provides a base pushing surface 910*f* which is movable in the z-direction from a position in the negative z-direction above the uppermost extent of forming surfaces 922, 932, namely above the plane defined by surfaces 932*d* and 922*d*, to a position coplanar with the lowest extent of lower first forming surfaces 921*c*, 921*d*, 931*c*, 931*d*, 941*c*, 941*d*, 951*c*, 951*d*.

In the configuration of FIG. 9, forming element 910 has a pushing surface 910*f* which has a shape and size which corresponds to base portion 101 and has forming side walls 910*a*, 910*b*, 910*c* and 910*d* which are arranged to correspond to respective edges 101*a*, 101*b*, 101*c* and 101*d* of base portion 101, as well as having joining curved edges 910*e*, 910*f*, 901*g* and 910*h* which correspond to curved edge portions 101*e*, 101*f*, 101*g* and 101*h* of base portion 101. The height of the respective side walls of forming element 910 may correspond to, or may be slightly smaller than, the intended spacing between base 101 and lid 107 of box 200. However, a much lower height is possible to use, including a plate, rather than block, configuration. Forming element 910 is translated in the z-direction to move into and be withdrawn from the space between forming guides 920, 930, 940, 950 by ram 911, which may be moved by any conventional motive means, such as a hydraulic ram, an electromagnetic ram, a worm drive, or similar. Forming element 910 can have continuous walls or apertured walls, or the walls of the forming element can be defined by the outward-facing surfaces of forming projections such as pimples, ridges or pillars extending outwardly from the forming element.

The operation of the assembly device 900 shown in FIG. 9 will now be explained.

Blank 100 as shown in FIG. 1 is placed on surfaces 932*d* and 922*d* so as to lie in the x-y plane, such that base portion 101 is arranged directly vertically above and corresponding to the space between the innermost extent of forming guides 920, 930, 940, 950. Ram 911 is driven in the positive z-direction such that pushing surface 910*f* of forming element 910 contacts base portion 101. In some configurations, but not shown in FIG. 9, a second forming element may be positioned underneath base portion 101 in FIG. 9 so that base portion 101 is sandwiched between forming element 910 and the second forming element such that base surface 101 is tightly held between the opposing faces of the forming elements to maintain base surface 101 flat during the process. Under such a condition, forming element 910 and the second forming element, if present, move together in the positive z-direction.

Figure 10:
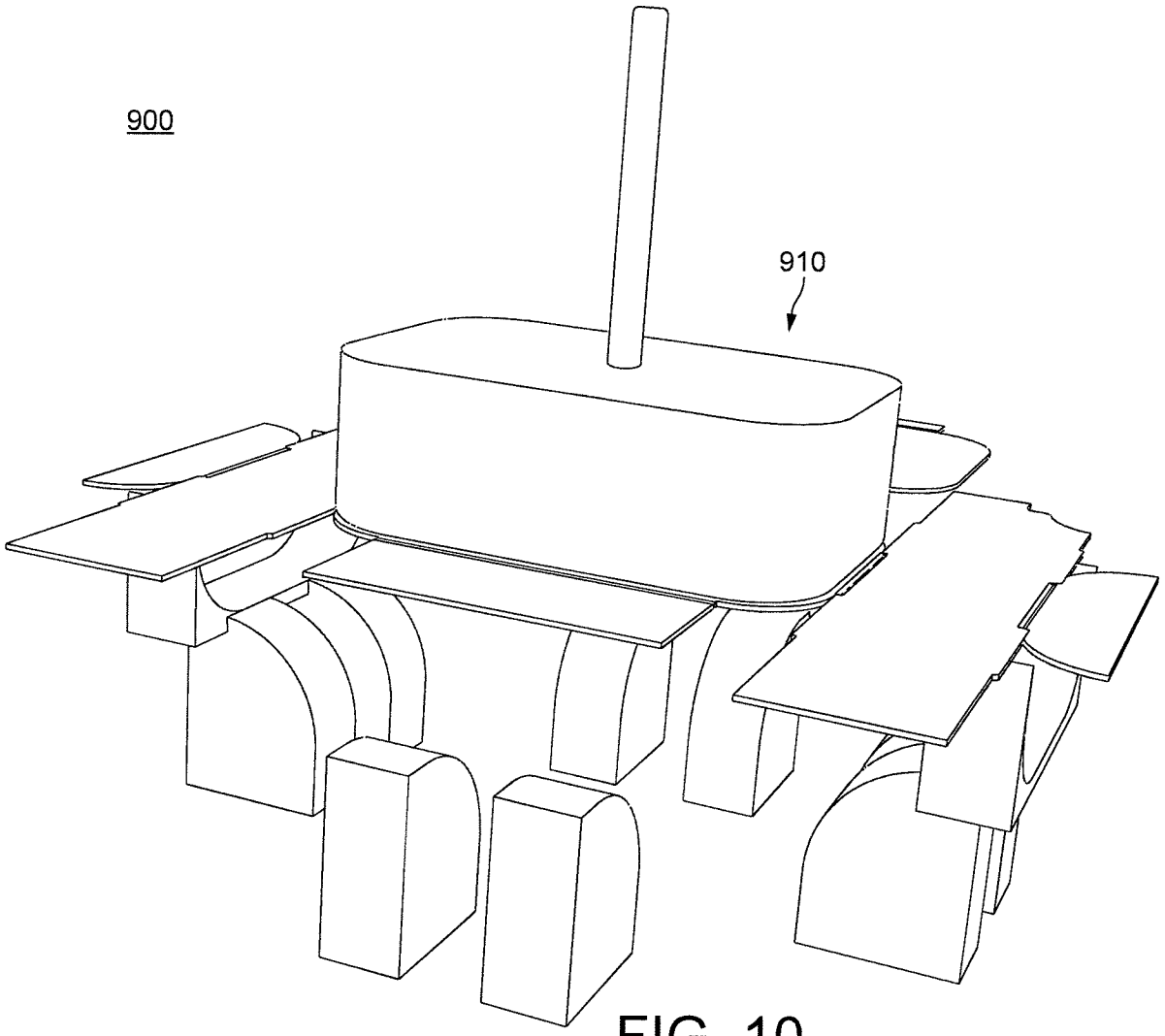

FIG. 10 shows forming element 910 having come into contact with base surface 101 of blank 100.

Figure 11:
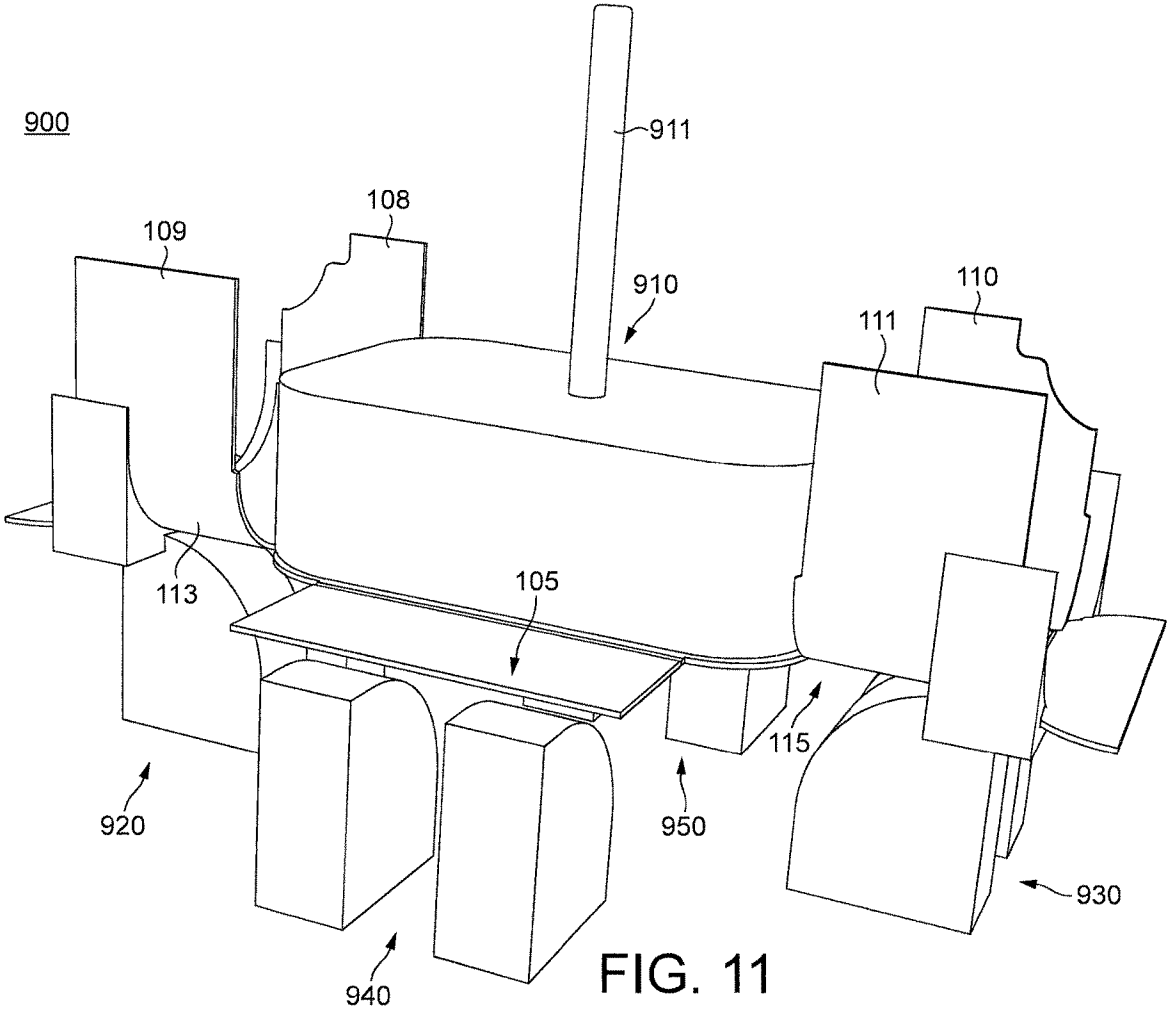

From the configuration of FIG. 10, forming element 910 continues to move in the positive z-direction, such that it reaches a position as shown in FIG. 11, wherein the forming surface 910*f* of forming element 910 is coplanar with lower surfaces 922*a*, 932*a*, of the second forming surfaces 922, 932. In this state, the curved portions 922*b*, 932*b*, 922*c*, 932*c* of the second forming surfaces 922, 932, have caused connecting portions 112, 113, 114, 115 to have adopted curved configurations, such that second side wall portions 108, 109, 110 and 111 project vertically upwards in the y-z plane. Notably, in FIG. 11, because of the height differences between the first pair of forming guides 920 and 930 and the second pair of forming guides 940, 950, side wall portions 102 and 103 are in contact with the top of the upper first forming surfaces 921*a*, 921*b*, 931*a*, 931*b*, while side tab portions 104 and 105 have not yet contacted the second pair of forming guides 940, 950.

From the configuration shown in FIG. 11, ram 911 continues to advance in the z-direction, causing forming element 910 and particularly pushing surface 910*f* of forming element 910 to continue also to move in the z-direction, forcing base portion 101 further down into the space between forming guides 920, 930, 940 and 950. In the current configuration shown in FIG. 12, contact with the upper first forming surfaces 921*a*, 921*b* and 931*a*, 931*b* of the first pair of forming guides has begun to rotate first wall portions 102 and 103 inward and upward towards the eventual intended vertical configuration, while side tabs 104, 105 have also begun to fold inward and upward toward their intended vertical positions. However, due to the height difference between the first pair of forming guides 920, 930 and the second pair of forming guides 940, 950 as regards the positioning of the upper first forming surfaces 921*a*, 921*b*, 931*a*, 931*b*, 941*a*, 941*b*, 951*a*, 951*b*, the angle which first side wall portions 102*a* and 103*a* have formed with the base is relatively greater than the angle which side tab portions 104 and 105 have formed with the base.

Figure 12:
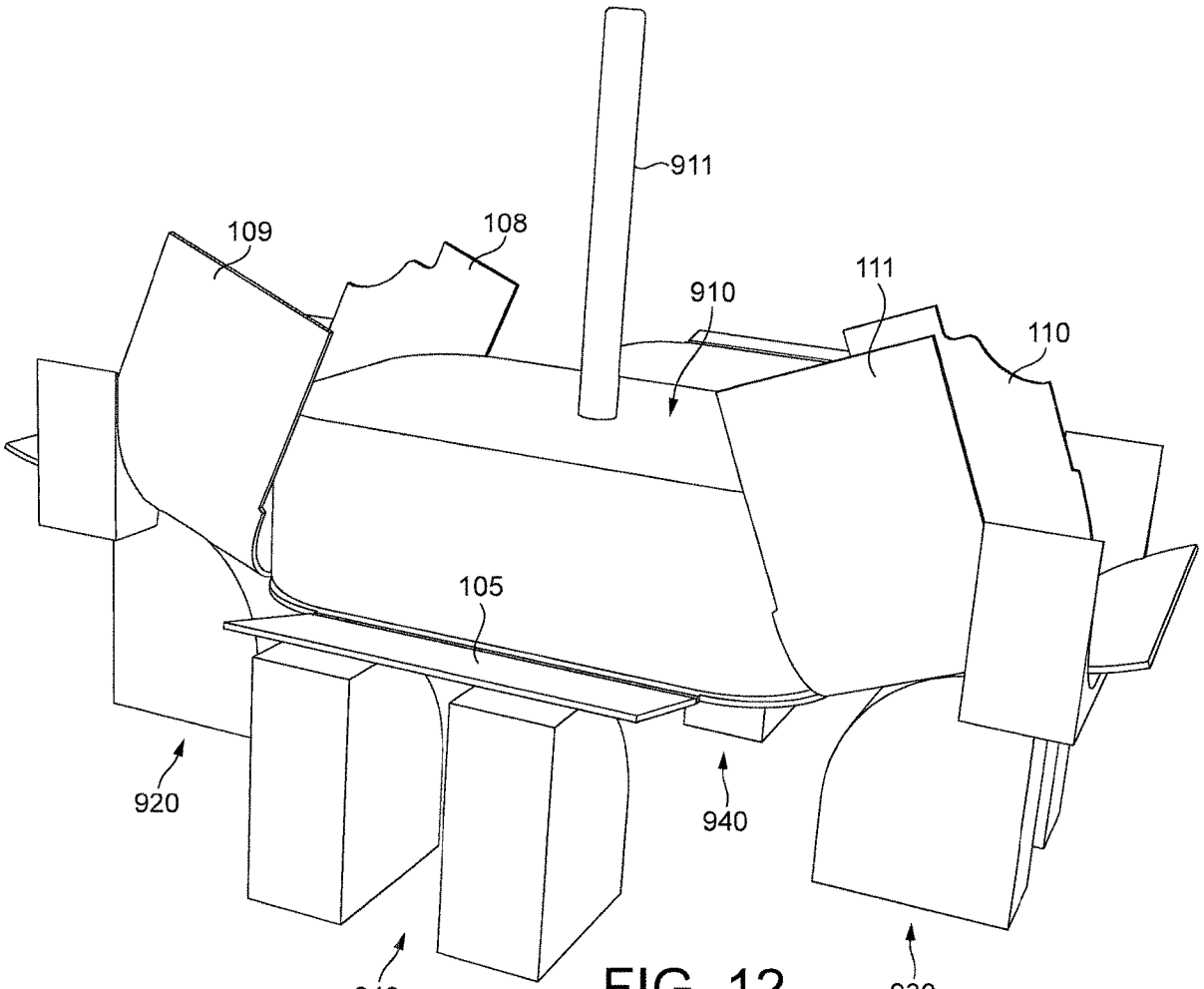
Figure 13:
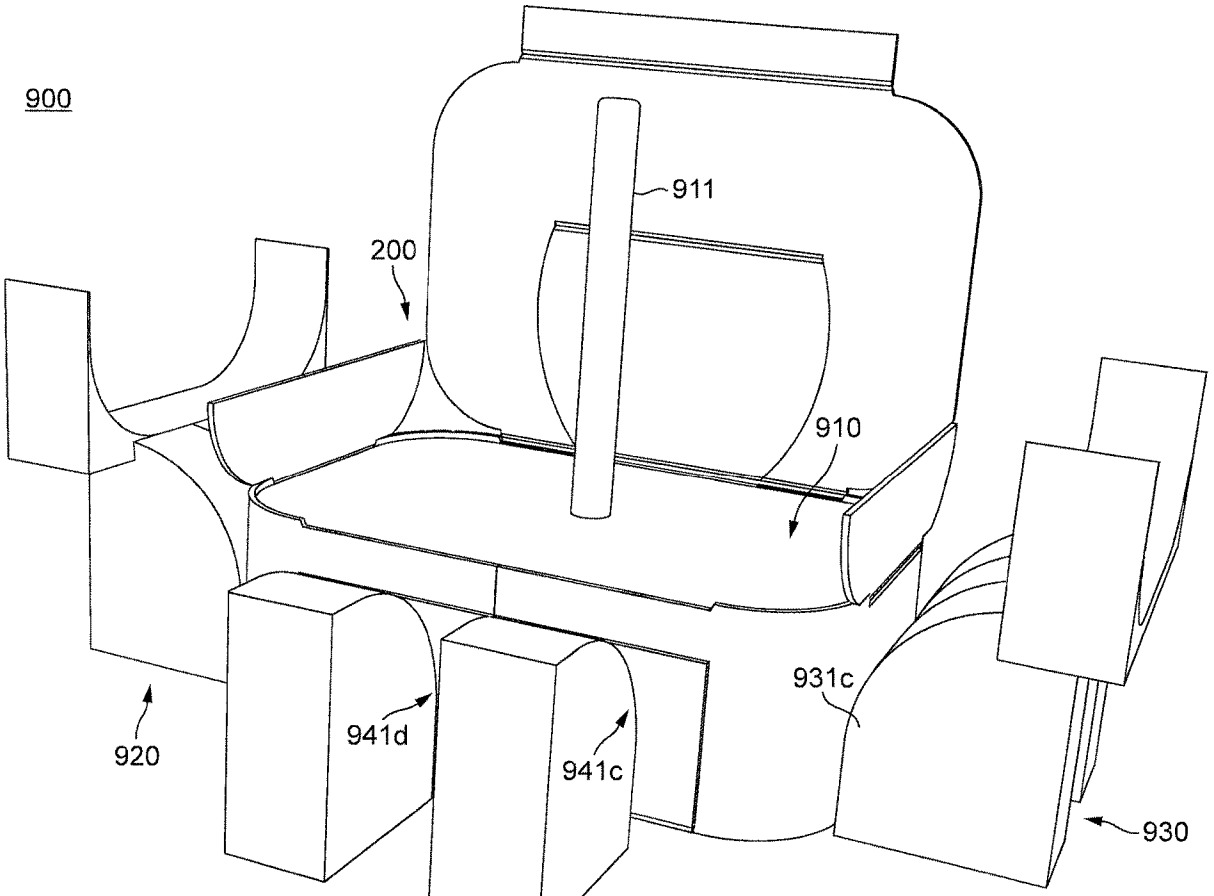

From the position shown in FIG. 12, ram 911 continues to advance in the z-direction, translating base portion 101 to its lowest position between the lower first forming surfaces 921*c*, 921*d*, 931*c*, 931*d*, 941*c*, 941*d*, 951*c*, 951*d* of the first and second pair of forming guides, such that first wall portion 102 is vertical and supported by lower first forming surface 921*c*, 921*d*. First wall portion 103 is also vertical and supported by lower first forming surface 931*c*, 931*d*. Side tab portion 104 is vertical and supported by lower first forming surface 951*c*, 951*d*. Side tab portion 105 is vertical and supported by lower first forming surface 941*c*, 941*d*. Forming element 910, in the present configuration and as shown in FIG. 13, substantially fills the internal space of box 200, which is now substantially formed. Especially, when forming element 910 has substantially the same shape as internal void of box 200, at least insofar as having the same cross-sectional shape as the periphery of first and second side wall portions and the connecting portions therebetween, which, in the present embodiment, corresponds to the periphery of base portion 101 and lid portion 106, the structural integrity of the box is assured during the formation process. If the pushing surface of forming element 910 is not contiguous, structural integrity can be assured if sufficient support is given by the pushing surface to the inner surface of the first and second side wall portions.

Once the box has been assembled, it is possible to use appropriate fasteners, staples or rivets to hold the box in its position. Alternatively, appropriate portions of the blank can be covered with bonding means such as an adhesive. Such bonding means can be applied either when the blank is in its flat state, as shown in FIG. 1, or at an appropriate point during the formation process, such as, for example, the state shown in FIG. 12. This latter approach ensures that the bonding means is fresh. As the formation process continues, the surfaces bearing the bonding means are brought to lie against each other and pressed together during the formation process.

With reference to FIG. 1, appropriate surfaces for the provision of adhesive are, for example, inner surface of side tab portions 104 and 105, the outer surfaces of side wall portions 108, 109, 111 and 110, the lid-facing surfaces of lid support portions 116 and 117, the lid support portion facing surfaces of lid portion 106, and the inner surface of lid tab portion 107. Of course, in configurations in which portions which are explained in the above embodiment to lie inside other portions actually, alternatively, lie outside those portions, such as providing side tab portions 104 and 105 inside corresponding side wall portions 108, 109, 110 and 111, providing lid tab portion 107 to lie inside side wall portions 109 and 111, or providing lid support portions 116 and 117 to lie on top of lid portion 106, rather than beneath lid 106, the adhesive would be applied on the alternate surface of these portions.

Figure 14:
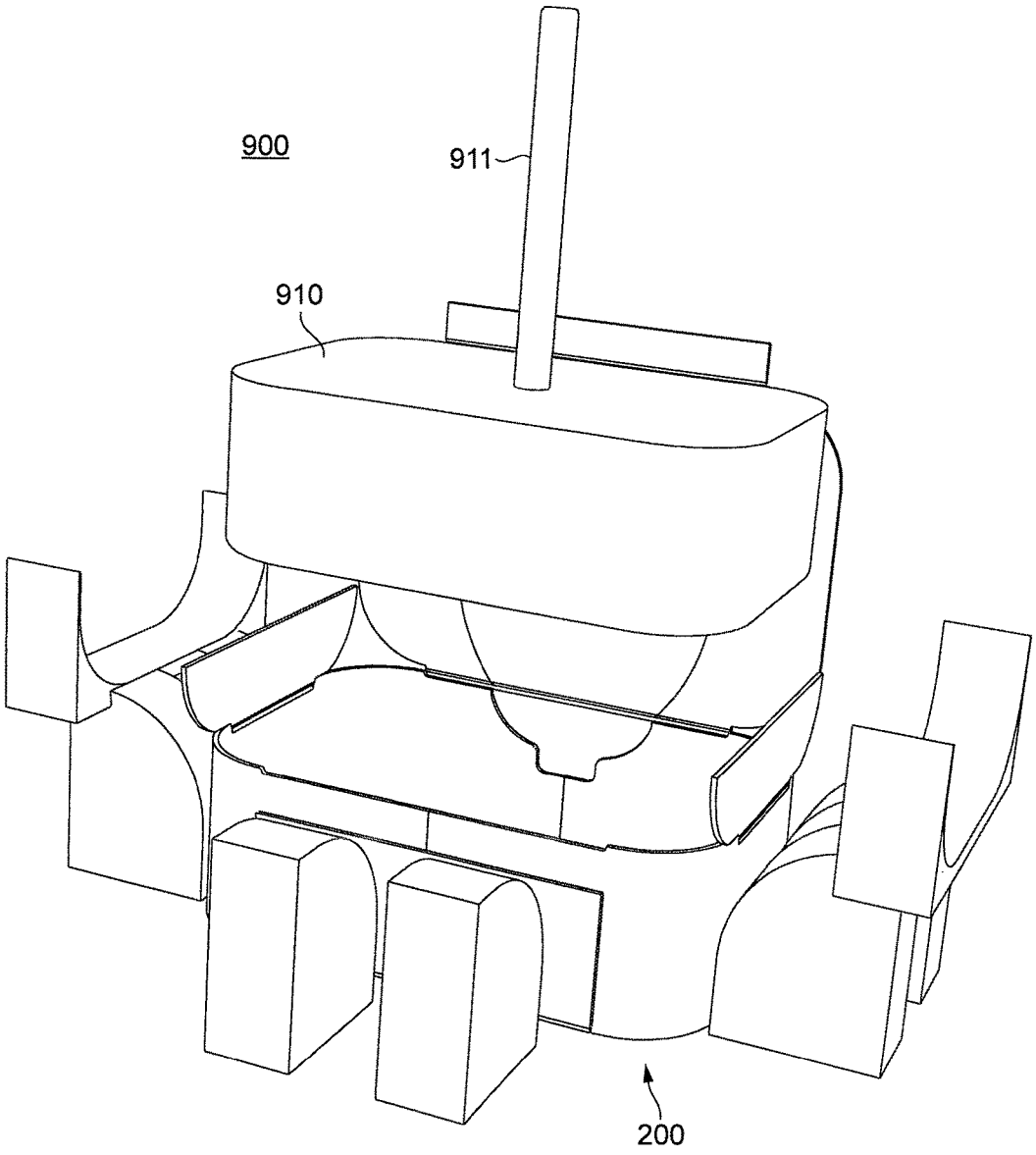
Figure 15:
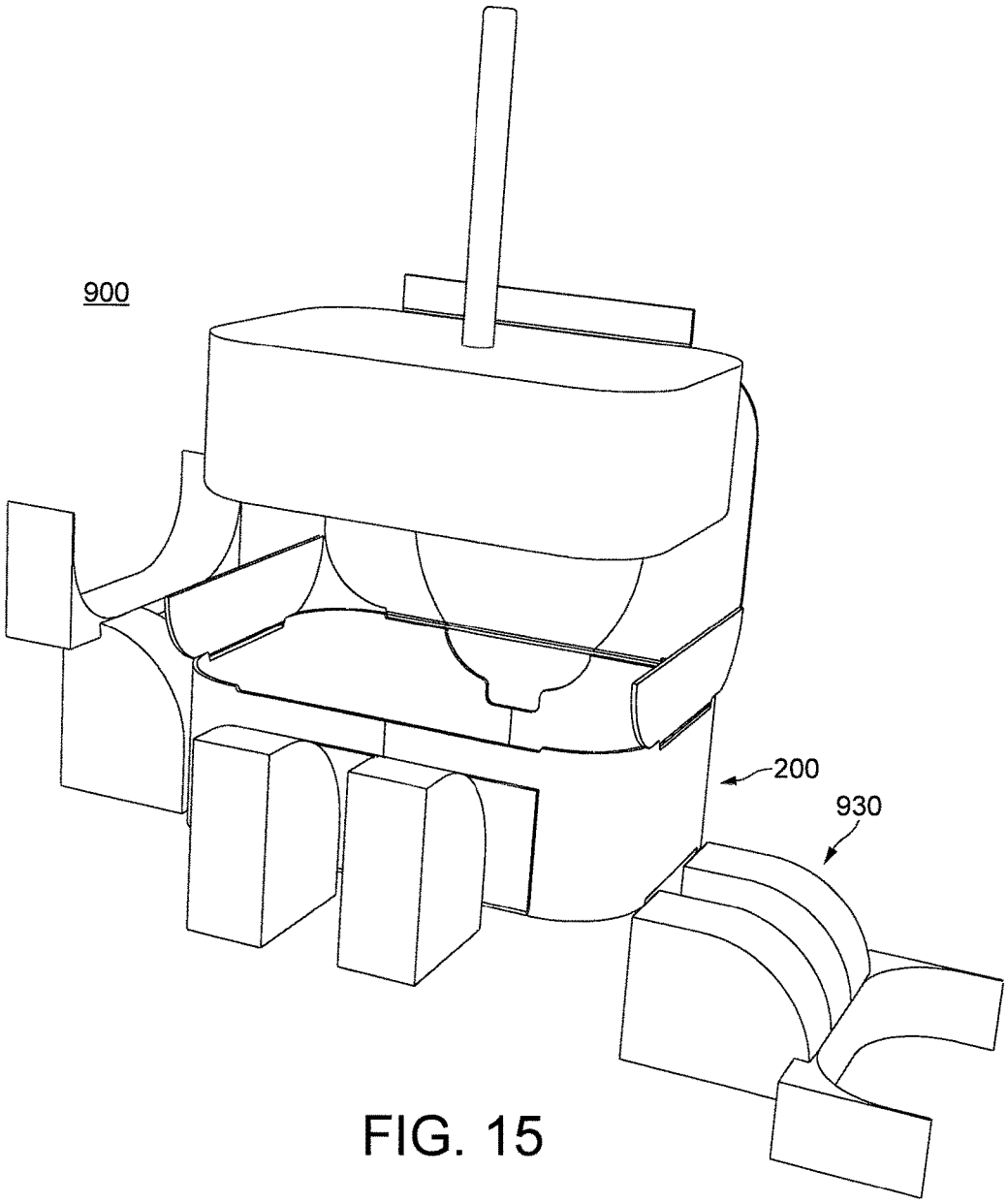
Figure 16:
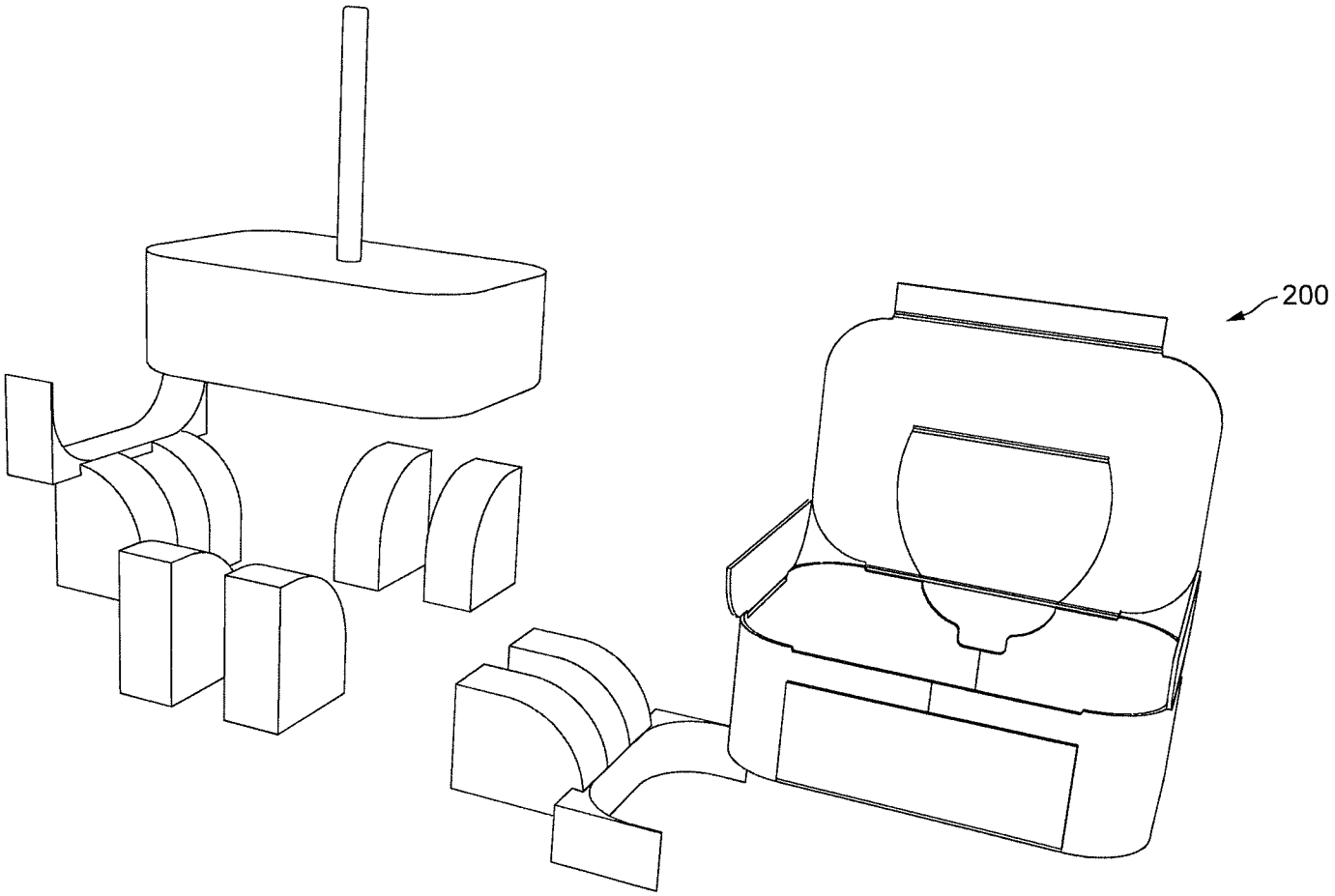
Figure 17:
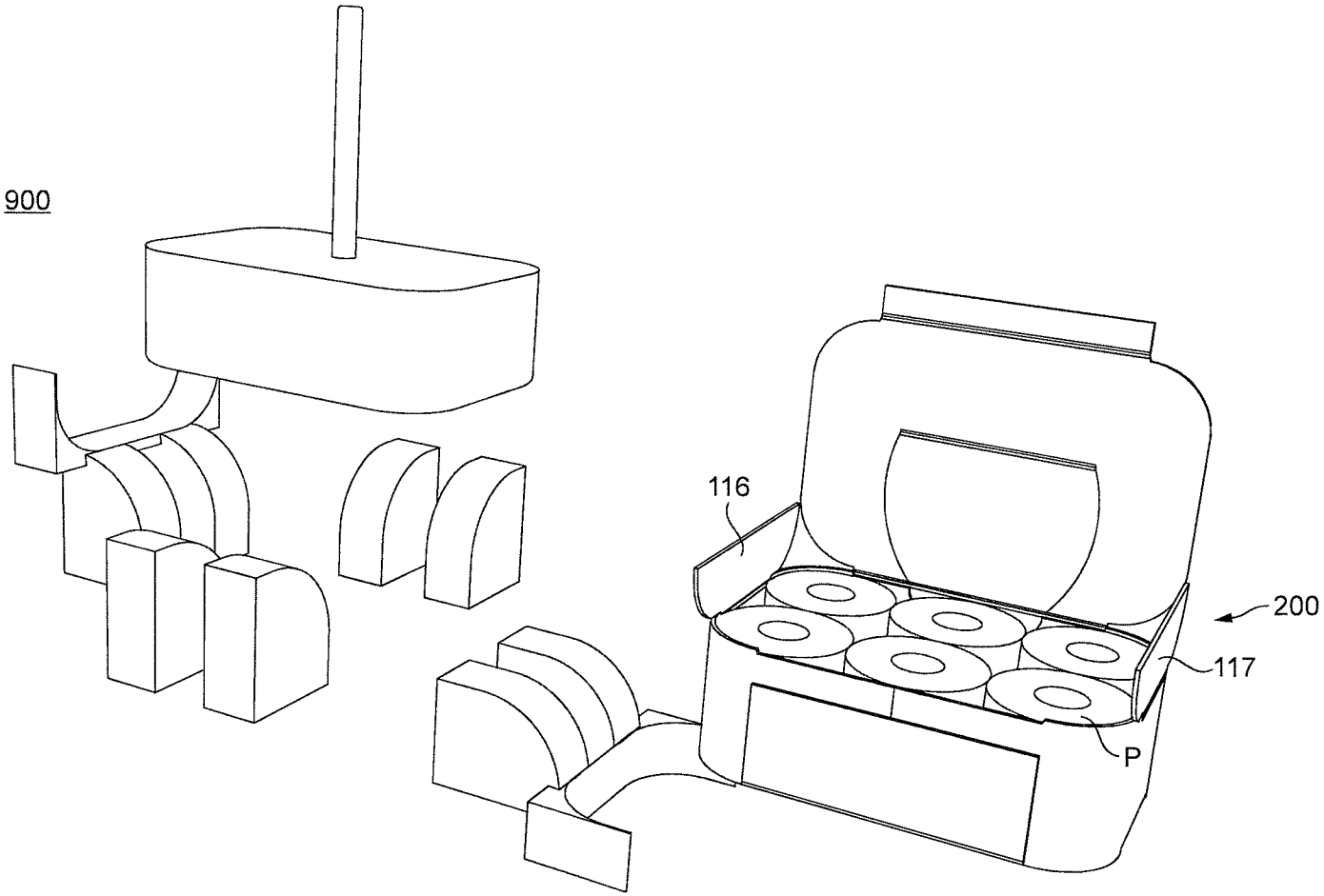
Figure 18:
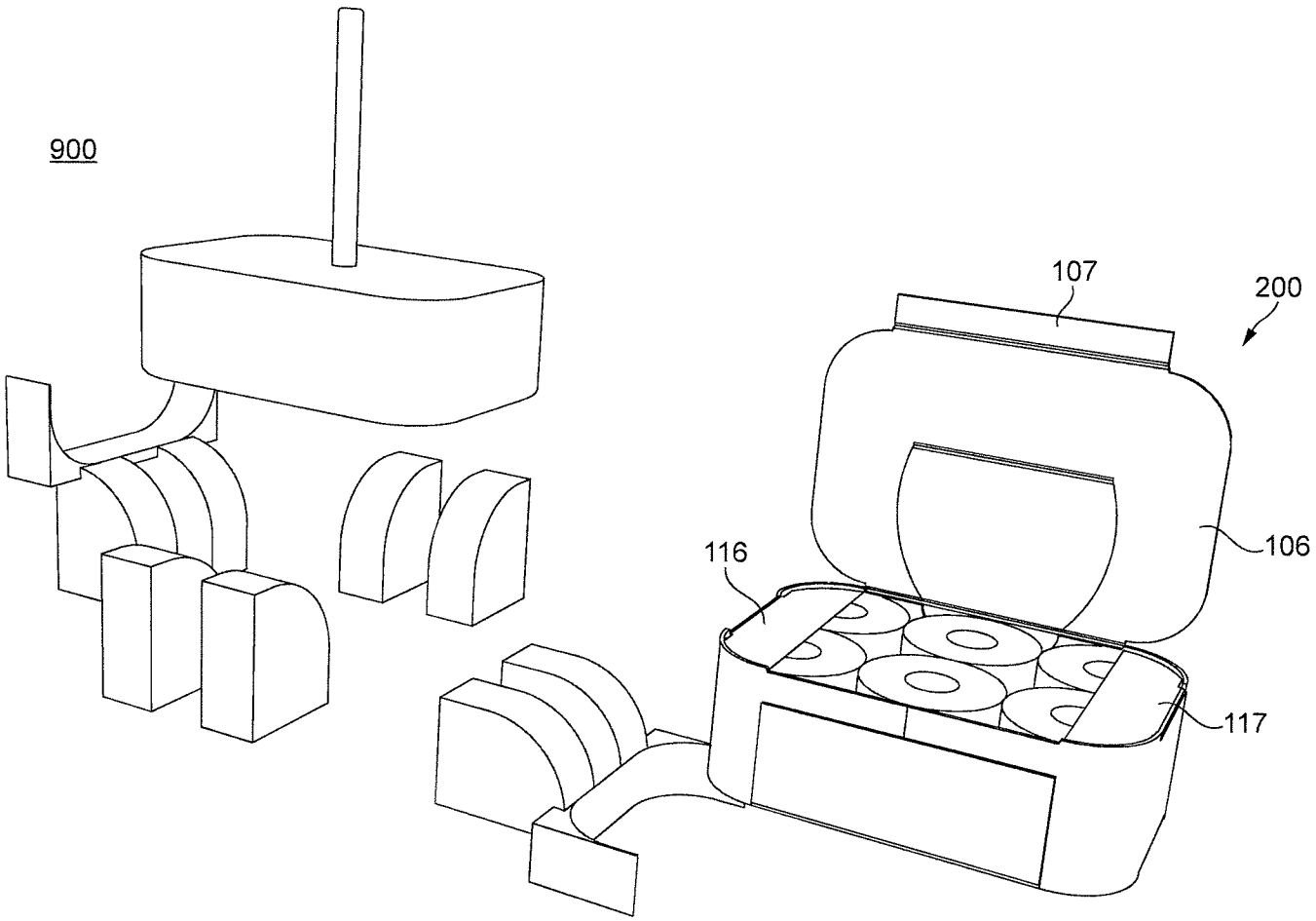
Figure 19:
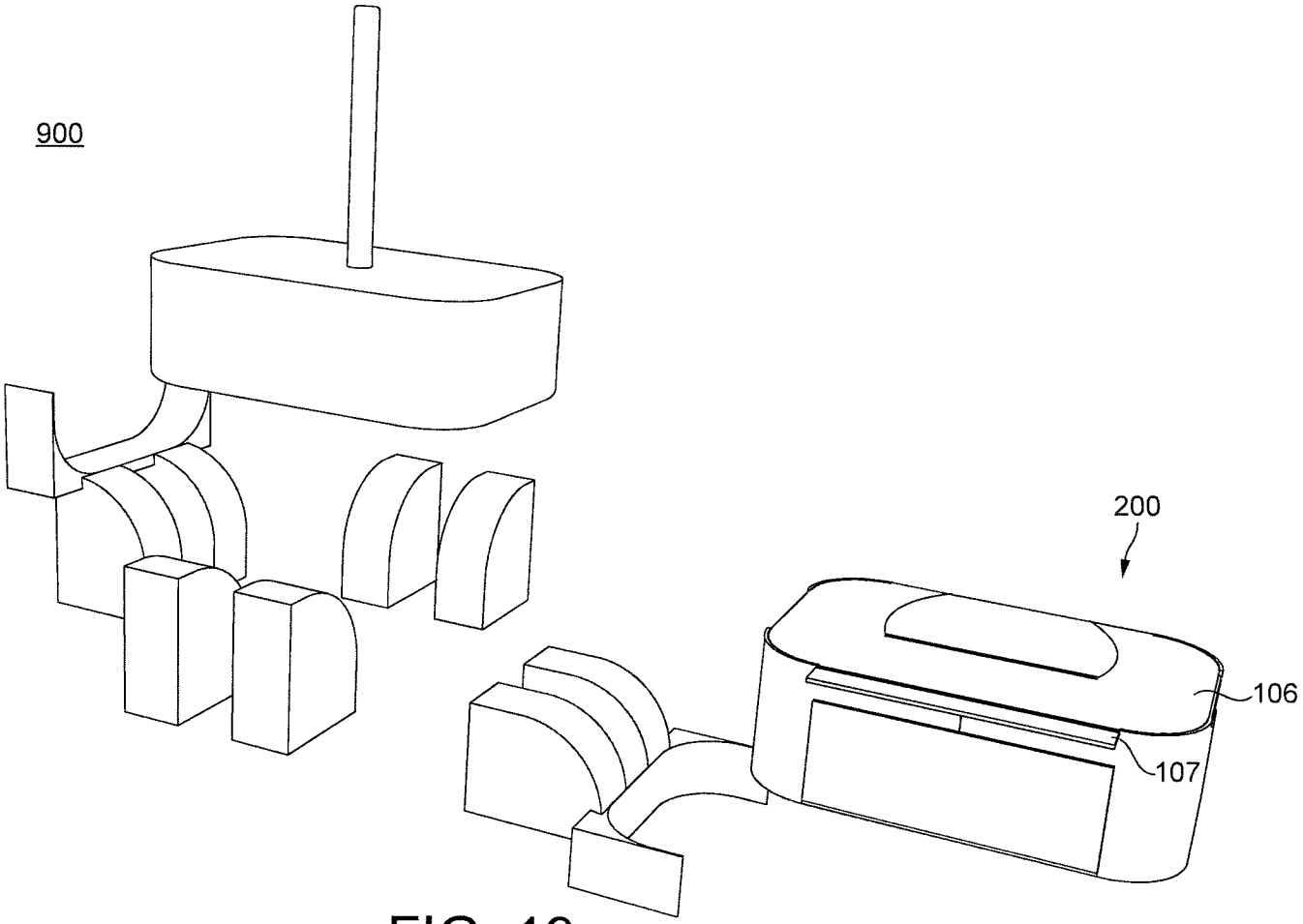
Figure 20:
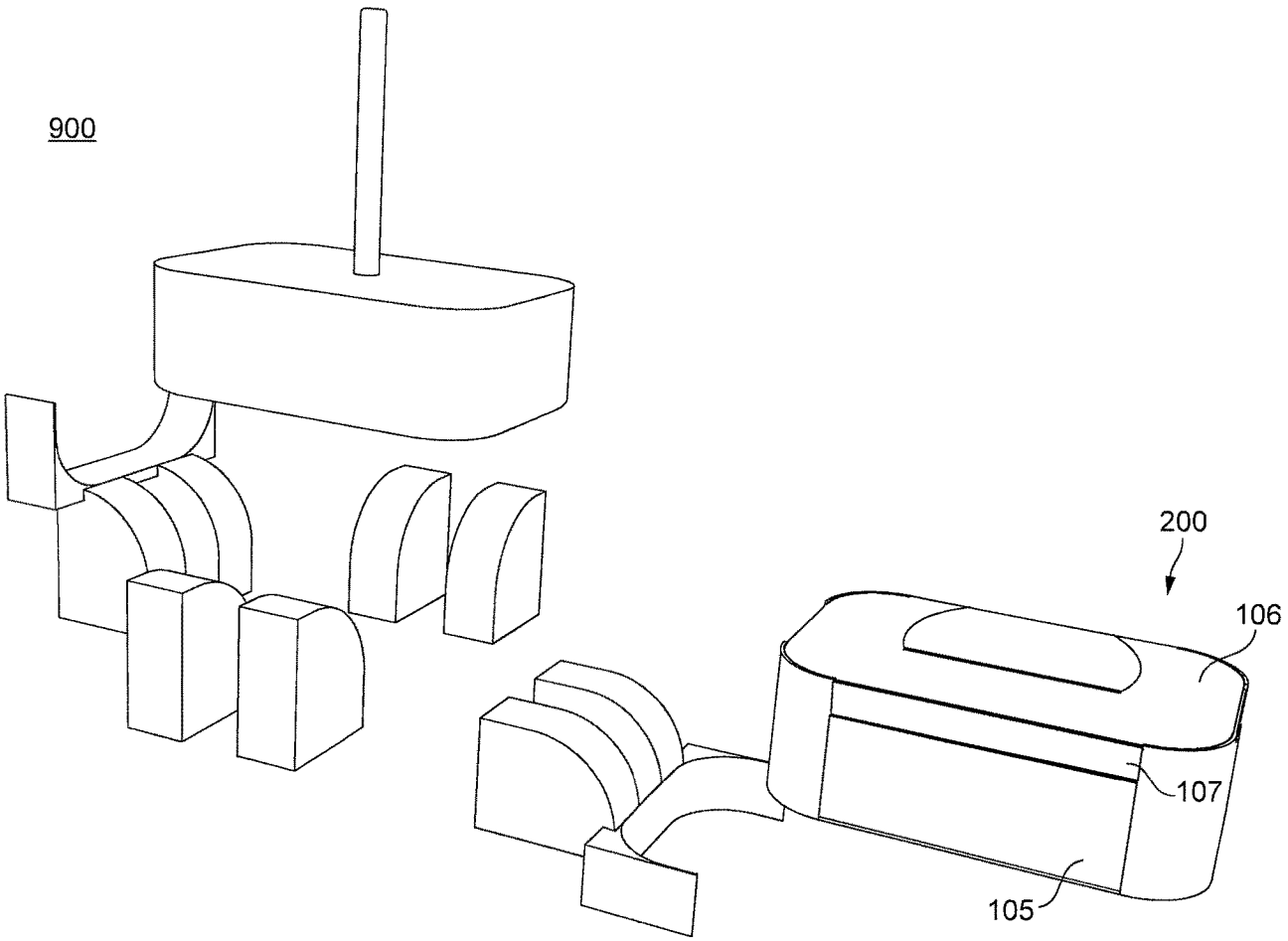

From the position shown in FIG. 13, ram 911 can be retracted to remove forming element 910 from the void inside box 200, as shown in FIG. 14. From the configuration shown in FIG. 14, one of the first pair of forming guides 930 can be removed, for example by rotating it or translating it away from its position, shown in FIG. 15, such that box 200 can be removed to the position shown in FIG. 16. Product P can be placed in the box, as shown in FIG. 17, corresponding to the state shown in FIG. 5, the lid support portions 116 and 117 can be folded to be coplanar, to reach the state shown in FIG. 18, corresponding to the state shown in FIG. 5. The lid portion can then be closed, as shown in FIG. 19, and lid tab portion 107 can then be arranged to be coplanar with side wall tab portion 105 as shown in FIG. 20, which corresponds to the state achieved in FIG. 8.

Notably, the disclosed method and apparatus for assembling box 200 from blank 100, can be adapted to suit any variations in the blank 100 and the box 200 described or suggested above, or which may occur to the skilled reader considering this disclosure and its applications. Particularly, the dimensions and positions of the various forming guides and the forming element can be adjusted to suit different box geometries. Furthermore, by arranging the second pair of forming guides 940, 950 to be relatively higher, namely translated in the negative z-direction than the first pair of forming guides 920, 930, side wall tab portions 104, 105 can be elevated to a vertical position before the first pair of side wall portions 102, 103 reach the vertical position, such that the side tab portions 104, 105 lie inside, rather than outside, side wall portions 108, 109, 110, 111. In such a case, lid tab portion 107 may be arranged inside, rather than outside, side wall portions 109, 111.

In some configurations, the forming element 910 can be hollow and can contain product which is released into the box when the forming element is withdrawn. In such a case, pushing surface 910*f* of forming element 910 minimally includes the edges of the vertical walls of the forming element, together with such base portions of the products as may be exposed.

The above embodiments employ portions of the board blank 100 which become curved, rather than folded, when the blank is assembled into box 200. To achieve such curves, a variety of materials may be selected to form the box. For example, as the skilled reader will appreciate, a variety of plastic sheet materials may be smoothly bent into a curved form to achieve the configuration shown in FIG. 8. Here, smoothly curved should be interpreted to mean having a continuous form without any kinks or cracks. Other card-type materials can also be contemplated, provided that the radius of curvature is not so much as to cause creasing or folding. Straightforward experimentation will allow the skilled person to select thicknesses and compositions of a wide variety of materials which may be appropriately curved and which may fulfil other engineering requirements for the packaging box. However, in certain embodiments, the material for forming the blank 100 of FIG. 1, and the resulting box 200, is the bendable board disclosed in the co-pending International application published as WO 2013/012362 A1, which allows even small-radius corners to be obtained reliably and without creasing. Such a bendable board has in one configuration a middle layer, a first outer layer attached to the middle layer and a second outer layer attached to the middle layer. The middle layer may be corrugated, and the second outer layer may have a lower bending stiffness according to ISO 5628 than the first outer layer. The bendable board may therefore be outwardly bendable only in a direction towards which the second layer faces.

Advantages of the blank and box of the present configuration include that portions having a smoothly curved form can be provided so as to curve from the planar surfaces of the first pair of side wall portions to the planar surfaces of the second pair of side wall portions without creases, folds, or sharp changes in angle. By providing such curved connecting portions, the edges joining the various side faces are strengthened.

Furthermore, the box 200 is easy to assemble in both a manual, machine assisted or automated fashion, and is economical in the use of materials.

In the light of the foregoing disclosure, there will be many alternatives which implement the teaching of the present disclosure. It is expected that one skilled in the art will be able to modify and adapt the above disclosure to suit his own circumstances and requirements within the scope of the present invention, while retaining some or all technical effects of the same, either disclosed or derivable from the above, in the light of his common general knowledge of the art. All such equivalents, modifications or adaptions fall within the scope of the invention hereby defined and claimed.

The invention claimed is:

1. A packaging box comprising:

a base portion defining a first plane; and at least one first side wall portion arranged at an angle to the base portion, the first side wall portion being joined to the base portion via a fold line at a first edge of the base portion, the first side wall portion having a pair of extension portions extending from opposite edges of the first side wall portion so as to provide at least part of a pair of second side wall portions arranged at an angle to the base portion and at an angle to the first side wall portion, each side wall portion of the pair of second side wall portions comprising at least part of one of the pair of extension portions extending from the first side wall portion, a connecting portion of each extension portion connecting the first side wall portion to one of the pair of second side wall portions being smoothly curved;

at least one side tab portion arranged at an angle to the base portion and being joined to the base portion via a fold line at an edge of the base portion such that the side tab portion lies against a surface of the respective extension portion of the first side wall portion; and at least one lid portion, the at least one lid portion being joined to the side tab portion via a fold line and extending at an angle to the respective first side wall portion for at least partially closing the packaging box, wherein the pair of extension portions extending from opposite edges of the first side wall portion forming at least part of the pair of second side wall portions are planar and parallel to the other.

2. The packaging box of claim 1, wherein:

the at least one first side wall portion is one of a pair of first side wall portions arranged at an angle to the base portion, each of the pair of first side wall portions being joined to the base portion via a fold line at a first pair of opposite edges of the base portion;

each side wall portion of the pair of first side wall portions having a pair of extension portions extending from opposite sides of the respective pair of first side wall portions so as to provide at least part of the pair of second side wall portions arranged at an angle to the base portion and to the pair of first side wall portions, each side wall portion of the pair of second side wall portions comprising part of an extension portion extending from one side wall portion of the pair of first side wall portions and part of an extension portion extending from the other side wall portion of the pair of first side wall portions; and a connecting portion of each extension portion connecting one side wall portion of the pair of first side wall portions to one side wall portion of the pair of second side wall portions and being smoothly curved.

3. The packaging box of claim 2, further comprising a further lid portion, the further lid portion being joined to another of the pair of second side wall portions via a fold line and extending at an angle to the respective first side wall portion for at least partially closing the packaging box.

4. The packaging box of claim 3, further comprising a pair of side tab portions including the at least one tab portion arranged at an angle to the base portion and being joined to the base portion via a fold line at a pair of opposite edges of the base portion such that each side tab portion lies against a surface of a respective extension portion of the pair of first side wall portions, and wherein the lid portion is joined to another of the pair of side tab portions via a fold line.

5. The packaging box according to claim 3, wherein the lid portion extends as far as each of the first and second side wall portions.

6. The packaging box according to claim 5, wherein the lid is provided with a lid tab portion joined via a fold line to an edge of the lid portion opposite to the fold line joining the lid portion and the wall portion from which the lid portion extends, the lid tab portion being arranged to lie against the second side wall portion opposite to the second side wall portion from which the lid portion extends.

7. The packaging box according to claim 3, further comprising at least one lid support portion extending from one of the first side wall portions and being joined to the respective side wall portion via a fold line at an opposite edge of the side wall portion to the base portion.

8. The packaging box according to claim 3, wherein the lid support portion extends from the first side wall portion.

9. The packaging box according to claim 3, wherein the lid support portion extends from one side wall portion of the pair of second side wall portions other than the side wall portion from which the lid extends.

10. The packaging box according to claim 9, wherein the lid support portion extends from an edge of one of the side tab portions.

11. The packaging box according to claim 3, further comprising a pair of first lid portions joined to respective second side wall portions at edges of the pair of second side wall portions opposite to the base portion by respective fold lines and extending towards each other.

12. The packaging box according to claim 11, further comprising a pair of second lid portions joined to respective pair of first side wall portions at edges of the pair of first side wall portions by respective fold lines and extending towards each other so as to lie against the pair of first lid portions.

13. The packaging box according to claim 11, further comprising a pair of side tab portions including the at least one tab portion arranged at an angle to the base portion and being joined to the base portion via a fold line at a pair of opposite edges of the base portion such that each side tab portion lies against a surface of a respective extension portion of the pair of first side wall portions, wherein the pair of first lid portions extends from the pair of side tab portions.

14. The packaging box according to claim 11, wherein each of the pair of first lid portions extends across the base portion so as to form a complete lid in combination with the other of the pair of first lid portions.

15. The packaging box according to claim 14, wherein each of the pair of first lid portions extends at least halfway across the base portion when closed as to form a complete lid.

16. The packaging box of claim 1, further comprising:

a pair of side tab portions including the at least one tab portion arranged at an angle to the base portion and being joined to the base portion via a fold line at a pair of opposite edges of the base portion such that each side tab portion lies against a surface of a respective extension portion of the first side wall portion.

17. The packaging box of claim 16, wherein the side tabs define at least a part of the pair of second side wall portions.

18. The packaging box of claim 17, wherein the pair of side tabs each extend to the same distance perpendicular to a base of the first side wall portion.

19. The packaging box of claim 17, wherein a surface of each of the side tabs is fixed to a surface of the respective extension portion.

20. The packaging box according to claim 1, wherein at least one of the first side wall portion and the second side wall portions, optionally both, are perpendicular to the base.

21. The packaging box according to claim 1, wherein each of the connecting portions includes a first edge and a second edge arranged opposite to the first edge.

22. The packaging box according to claim 21, wherein the base portion includes curved edges, and wherein each of the connecting portions are smoothly curved such that a radius of curvature of the first edge of each connecting portion corresponds to a radius of curvature of respective curved edge of the base portion.

* * * * *